US006531830B2

(12) United States Patent
Akimoto et al.

(10) Patent No.: US 6,531,830 B2
(45) Date of Patent: Mar. 11, 2003

(54) DISCHARGE-LAMP DRIVE APPARATUS

(75) Inventors: Katsuhide Akimoto, Yokkaichi (JP); Akira Fujii, Yokkaichi (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/874,957

(22) Filed: Jun. 7, 2001

(65) Prior Publication Data

US 2002/0014865 A1 Feb. 7, 2002

(30) Foreign Application Priority Data

Jun. 8, 2000 (JP) ..... 2000-171967
Mar. 15, 2001 (JP) ..... 2001-074389

(51) Int. Cl.[7] ..... H05B 39/04
(52) U.S. Cl. ..... 315/224; 315/209 PZ; 315/293; 315/360
(58) Field of Search ..... 315/224, 209 PZ, 315/276, 283, 291, 293, 300, 307, 308, 360

(56) References Cited

U.S. PATENT DOCUMENTS 5,731,652 A * 3/1998 Shimada ..... 310/316.01
5,768,111 A * 6/1998 Zaitsu ..... 310/316.01
5,894,184 A * 4/1999 Furuhashi et al. ..... 310/316.01
5,942,835 A * 8/1999 Furuhashi et al. ..... 310/316.01

FOREIGN PATENT DOCUMENTS

JP 11-97758 4/1999

* cited by examiner

*Primary Examiner*—Don Wong
*Assistant Examiner*—Thuy Vinh Tran
(74) *Attorney, Agent, or Firm*—Nixon & Vanderhye P.C.

(57) ABSTRACT

An apparatus for driving a discharge lamp includes a piezoelectric transformer connected to the discharge lamp. A drive device operates for feeding controllable power to the discharge lamp via the piezoelectric transformer to controllably drive the discharge lamp. A lighting control device operates for controlling the drive device to light the discharge lamp. In addition, the lighting control device operates for controlling the drive device to feed a first current to the discharge lamp during a build-up time interval before the discharge lamp changes to a stably lighting state. After the build-up time interval, the drive device is controlled to feed a second current to the discharge lamp. The first current is greater than the second current.

13 Claims, 12 Drawing Sheets

DISCHARGE-LAMP DRIVE APPARATUS

BACKGROUND OF THE INVENTION

1. Field of the Invention

This invention relates to a discharge-lamp drive apparatus. This invention also relates to an apparatus for driving a metal halide lamp via a piezoelectric transformer. This invention further relates to power-feed control after a discharge lamp starts lighting.

2. Description of the Related Art

A typical drive apparatus for a discharge lamp includes a boosting transformer. When the lamp is required to start lighting, the boosting transformer is used to generate a starting voltage. The starting voltage is applied to the lamp so that the lamp starts lighting. After the start, power is fed to the lamp via another circuit. The typical drive apparatus has the problem that the boosting transformer is large in size.

Japanese patent application publication number 11-97758 discloses an apparatus in which a cold-cathode fluorescent lamp is activated by power fed via a piezoelectric transformer. In the apparatus of Japanese application 11-97758, the output terminal of a variable-frequency oscillation circuit is connected to the primary side of the piezoelectric transformer through a waveform shaping circuit and a drive circuit. The secondary side of the piezoelectric transformer is connected to the lamp. A start control circuit and an oscillation control circuit are connected to the variable-frequency oscillation circuit. At the start of the activation of the lamp, the start control circuit equalizes the frequency of oscillation of the variable-frequency oscillation circuit to about the resonant frequency of the piezoelectric transformer. After the lamp starts lighting, the operation of the start control circuit is suspended and instead the oscillation control circuit adjusts the frequency of oscillation of the variable-frequency oscillation circuit to maintain the current flowing through the lamp at approximately a constant level. Specifically, a detection resistor is connected in series with the lamp. The detection resistor senses the current flowing through the lamp. Information of the sensed current is fed back to the oscillation control circuit. The frequency adjustment by the oscillation control circuit is responsive to the sensed current.

The apparatus of Japanese application 11-97758 has the problem that after the start, the lamp takes a relatively long time until falling into a stably lighting state.

SUMMARY OF THE INVENTION

It is an object of this invention to provide a discharge-lamp drive apparatus which can bring the lamp into a stably lighting state in a relatively short time after the start thereof.

A first aspect of this invention provides an apparatus for driving a discharge lamp. The apparatus comprises a piezoelectric transformer connected to the discharge lamp; drive means for feeding controllable power to the discharge lamp via the piezoelectric transformer to controllably drive the discharge lamp; lighting control means for controlling the drive means to light the discharge lamp, the lighting control means including means for controlling the drive means to feed a first current to the discharge lamp during a build-up time interval before the discharge lamp changes to a stably lighting state; and means for controlling the drive means to feed a second current to the discharge lamp after the build-up time interval; wherein the first current is greater than the second current.

A second aspect of this invention is based on the first aspect thereof, and provides an apparatus wherein the lighting control means comprises impedance detecting means for detecting an impedance of the discharge lamp; and drive-state changing means for determining that the build-up time interval ends when the impedance detected by the impedance detecting means exceeds a predetermined value, and for controlling the drive means to change the discharge lamp from a drive state for the build-up time interval to a drive state for a stably-lighting time interval when determining that the build-up time interval ends.

A third aspect of this invention is based on the first aspect thereof, and provides an apparatus wherein the lighting control means comprises means for controlling the drive means to feed a third current to the discharge lamp during a former stage of the build-up time interval; and means for controlling the drive means to feed a fourth current to the discharge lamp during a latter stage of the build-up time interval, the third current being smaller than the fourth current.

A fourth aspect of this invention is based on the third aspect thereof, and provides an apparatus wherein the lighting control means comprises impedance detecting means for detecting an impedance of the discharge lamp, and drive-state changing means for determining that the former stage of the build-up time interval is replaced by the latter stage of the build-up time interval when the impedance detected by the impedance detecting means drops below a predetermined value, and for controlling the drive means to change the discharge lamp from a drive state for the former stage of the build-up time interval to a drive state for the latter stage of the build-up time interval when determining that the former stage of the build-up time interval is replaced by the latter stage of the build-up time interval.

A fifth aspect of this invention is based on the first aspect thereof, and provides an apparatus wherein the lighting control means comprises means for controlling the drive means so that during the build-up time interval, the power fed to the discharge lamp will be decreased toward a power value occurring after the build-up time interval.

A sixth aspect of this invention is based on the first aspect thereof, and provides an apparatus wherein the drive means operates at a variable drive frequency.

A seventh aspect of this invention is based on the sixth aspect thereof, and provides an apparatus further comprising means for controlling the drive frequency at which the drive means operates to adjust an intensity of light emitted from the discharge lamp in response to a light-intensity adjustment signal.

An eighth aspect of this invention is based on the sixth aspect thereof, and provides an apparatus wherein the drive frequency at which the drive means operates is higher than a resonant frequency of the piezoelectric transformer.

A ninth aspect of this invention is based on the first aspect thereof, and provides an apparatus wherein the drive means operates at a variable voltage.

A tenth aspect of this invention provides an apparatus for driving a discharge lamp. The apparatus comprises a piezoelectric transformer connected to the discharge lamp; first means for lighting the discharge lamp; second means for feeding a first power to the discharge lamp via the piezoelectric transformer after the discharge lamp is lighted by the first means; third means for detecting an impedance of the discharge lamp; fourth means for determining whether or not the impedance detected by the third means exceeds a predetermined value after the discharge lamp is lighted by the first means; and fifth means for feeding a second power to the discharge lamp via the piezoelectric transformer after the fourth means determines that the impedance exceeds the predetermined value, the second power being smaller than the first power.

An eleventh aspect of this invention is based on the tenth aspect thereof, and provides an apparatus further comprising sixth means for decreasing the first power fed to the discharge lamp during a time interval after the discharge lamp is lighted and before the fourth means determines that the impedance exceeds the predetermined value.

A twelfth aspect of this invention provides a method of driving a discharge lamp via a piezoelectric transformer. The method comprises the steps of lighting the discharge lamp; feeding a first power to the discharge lamp via the piezoelectric transformer after the discharge lamp is lighted; detecting an impedance of the discharge lamp; determining whether or not the detected impedance exceeds a predetermined value after the discharge lamp is lighted; and feeding a second power to the discharge lamp via the piezoelectric transformer after it is determined that the impedance exceeds the predetermined value, the second power being smaller than the first power.

A thirteenth aspect of this invention is based on the twelfth aspect thereof, and provides a method further comprising the step of decreasing the first power fed to the discharge lamp during a time interval after the discharge lamp is lighted and before it is determined that the impedance exceeds the predetermined value.

DETAILED DESCRIPTION OF THE INVENTION

A prior-art discharge-lamp drive apparatus will be explained below for a better understanding of this invention.

Figure 1:
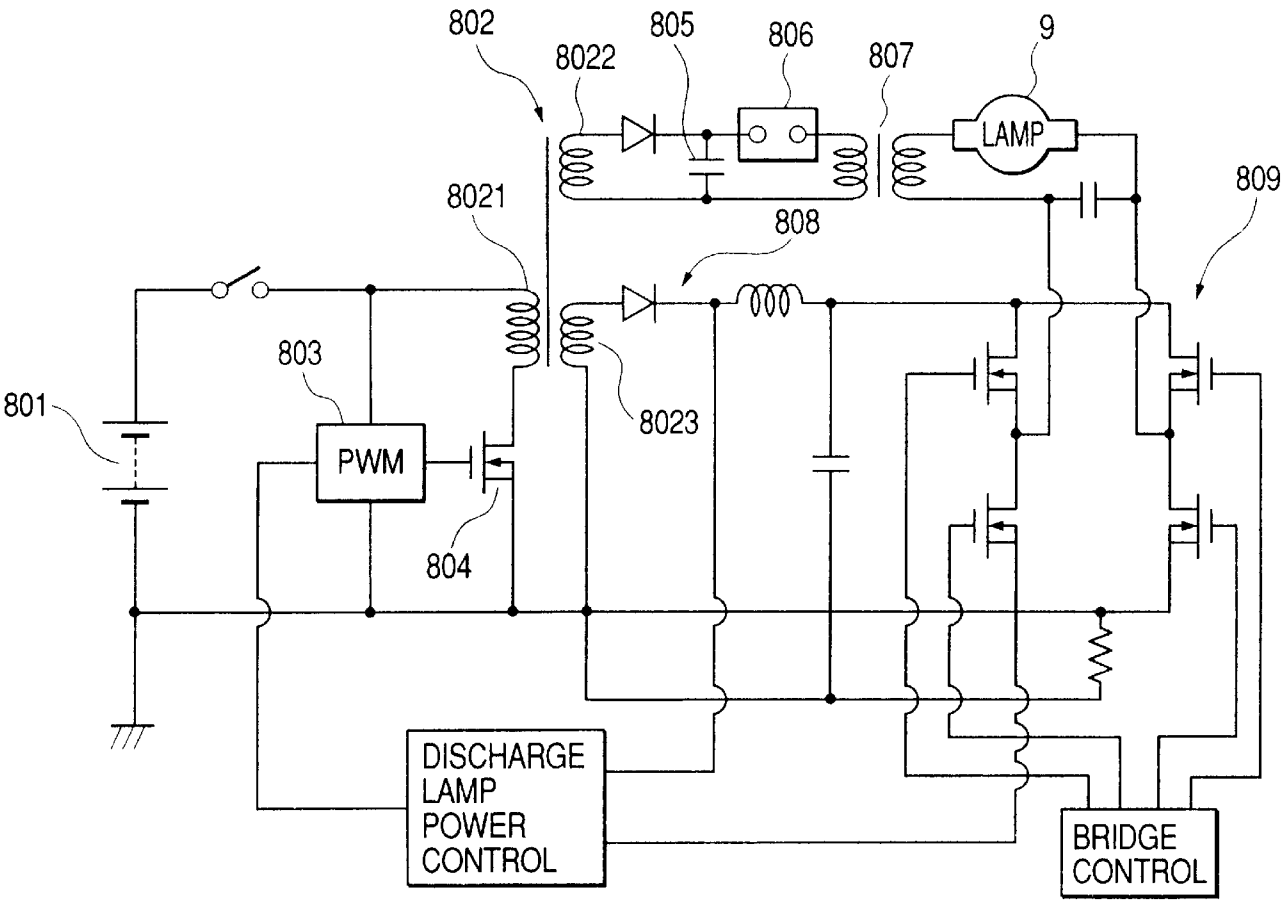
FIG. 1 PRIOR ART
FIG. 1 is a diagram of a prior-art discharge-lamp drive apparatus.

With reference to FIG. 1, a prior-art discharge-lamp drive apparatus includes a power supply 801 such as a battery. Power can be fed from the power supply 801 to a primary winding 8021 of a transformer 802. A PWM (pulse-width modulation) circuit 803 controls a transistor 804, making intermittent the feed of power from the power supply 801 to the primary winding 8021 of the transformer 802.

To start a discharge lamp 9 lighting, the prior-art apparatus of FIG. 1 operates as follows. The intermittent feed of power to the primary winding 8021 of the transformer 802 causes a high voltage to occur across a secondary winding 8022 thereof. A capacitor 805 is charged by the high voltage. When the voltage across the capacitor 805 exceeds a given level, power is fed from the capacitor 805 to the lamp 9 via a discharge gap 806 and a starting transformer 807. The fed power has a starting voltage by which the lamp 9 is started to light.

After the start, the lamp 9 is fed with power as follows. The transformer 802 has another secondary winding 8023 connected to a rectifying circuit 808. The PWM circuit 803, the transistor 804, the transformer 802, and the rectifying circuit 808 compose a DC-DC converter for generating a high-voltage DC power from a low-voltage DC power fed by the power supply 801. An inverter circuit 809 following the DC-DC converter changes the high-voltage DC power to a high-voltage AC power. After the start, the lamp 9 is activated by the high-voltage AC power fed from the inverter circuit 809.

The prior-art apparatus of FIG. 1 has the problem that the transformers 802 and 807 are large in size.

First Embodiment

Figure 2:
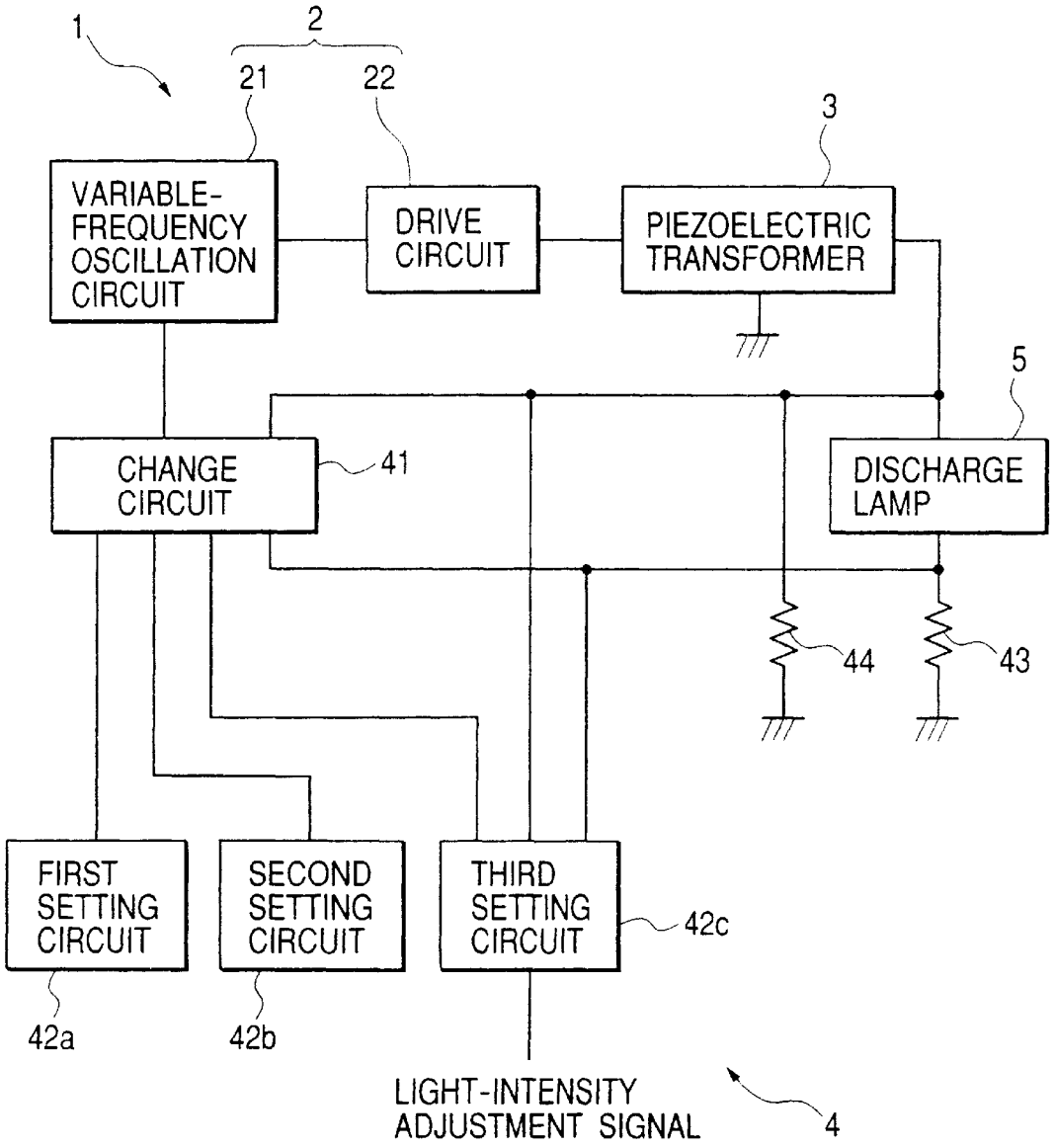
FIG. 2 is a block diagram of a discharge-lamp drive apparatus according to a first embodiment of this invention.

FIG. 2 shows a discharge-lamp drive apparatus 1 according to a first embodiment of this invention. The apparatus 1 is designed to drive a discharge lamp 5. The discharge lamp 5 includes a metal halide lamp.

The apparatus 1 includes a drive device 2. The drive device 2 is composed of a variable-frequency oscillation circuit 21 and a drive circuit 22. The drive device 2 generates first AC power. The drive device 2 feeds the first AC power to a piezoelectric transformer 3. The drive circuit 22 is connected between the output side of the variable-frequency oscillation circuit 21 and the primary side of the piezoelectric transformer 3. The variable-frequency oscillation circuit 21 includes a voltage-controlled oscillator. The variable-frequency oscillation circuit 21 is connected to a change circuit 41 which acts as a frequency changing device. The frequency of oscillation of the variable-frequency oscillation circuit 21 is set by a voltage signal fed from the change circuit 41. The drive circuit 22 includes a power amplifier. The drive circuit 22 receives the output signal of the variable-frequency oscillation circuit 21. The drive circuit 22 converts the output signal of the variable-frequency oscillation circuit 21 into first AC power having a given amplitude and a frequency equal to the frequency of oscillation of the variable-frequency oscillation circuit 21. The first AC power is fed to the primary side of the piezoelectric transformer 3. Thus, the piezoelectric transformer 3 can be driven at the frequency of the first AC power, that is, the frequency of oscillation of the variable-frequency oscillation circuit 21. The piezoelectric transformer 3 is of, for example, a Rosen type. The piezoelectric transformer 3 boosts the first AC power into second AC power which appears at the secondary side thereof.

A first detection resistor 43 is connected in series with the discharge lamp 5. The series combination of the discharge lamp 5 and the first detection resistor 43 is connected to the secondary side of the piezoelectric transformer 3. Thus, the second AC power generated by the piezoelectric transformer 3 can be fed to the discharge lamp 5. A second detection resistor 44 is connected in parallel with the series combination of the discharge lamp 5 and the first detection resistor 43. A voltage across the first detection resistor 43 is inputted into the change circuit 41 as a detection signal. Also, a voltage across the second detection resistor 44 is inputted into the change circuit 41 as a detection signal. The first detection resistor 43 senses the current flowing through the discharge lamp 5. Thus, the detection signal generated by the first detection resistor 43 indicates the sensed current flowing through the discharge lamp 5. The second detection resistor 44 senses the voltage applied to the discharge lamp 5. Thus, the detection signal generated by the second detection resistor 44 indicates the sensed voltage applied to the discharge lamp 5.

The change circuit 41 includes, for example, a microcomputer having a combination of an input/output port, a CPU, a ROM, and a RAM. The change circuit 41 operates in accordance with a program stored in the ROM. The program is designed to control the change circuit 41 to implement steps of operation which will be mentioned hereinafter.

The change circuit 41 determines whether or not a current is flowing through the discharge lamp 5, that is, whether or not puncture of insulation occurs in the discharge lamp 5 on the basis of the detection signal generated by the first detection resistor 43. The change circuit 41 gets information of the start of the lighting of the discharge lamp 5 from the result of the above-mentioned determination. The first and second detection resistors 43 and 44, and the change circuit 41 compose an impedance detection device. From the detection signal generated by the first detection resistor 43, the change circuit 41 gets information of the sensed current flowing through the discharge lamp 5. From the detection signal generated by the second detection resistor 44, the change circuit 41 gets information of the sensed voltage applied to the discharge lamp 5. The change circuit 41 divides the sensed voltage by the sensed current, thereby calculating the impedance of the discharge lamp 5. The change circuit 41 determines whether or not the calculated impedance of the discharge lamp 5 exceeds a predetermined reference value.

The change circuit 41 is connected to first, second, and third setting circuits 42*a*, 42*b*, and 42*c*. The first setting circuit 42*a* generates a first voltage which can decide the frequency of oscillation of the variable-frequency oscillation circuit 21. The first setting circuit 42*a* outputs the first voltage to the change circuit 41. The second setting circuit 42*b* generates a second voltage which can decide the frequency of oscillation of the variable-frequency oscillation circuit 21. The second setting circuit 42*b* outputs the second voltage to the change circuit 41. The third setting circuit 42*c* generates a third voltage which can decide the frequency of oscillation of the variable-frequency oscillation circuit 21. The third setting circuit 42*c* outputs the third voltage to the change circuit 41. The change circuit 41 selects one from among the voltages outputted by the first, second, and third setting circuits 42*a*, 42*b*, and 42*c* in response to the detection signals generated by the first and second detection resistors 43 and 44. The change circuit 41 passes the selected voltage to the variable-frequency oscillation circuit 21 as the voltage signal for setting the frequency of oscillation thereof. In other words, the change circuit 41 selects one from among the first, second, and third setting circuits 42*a*, 42*b*, and 42*c*, and connects the selected one with the variable-frequency oscillation circuit 21.

The first setting circuit 42*a* is designed for starting the discharge lamp 5 lighting. The second setting circuit 42*b* is designed for power feed to the discharge lamp 5 during a build-up time interval or a transition time interval following the start of the lighting of the discharge lamp 5. The third setting circuit 42*c* is designed for power feed to the discharge lamp 5 during a stably lighting time interval following the build-up time interval (the transition time interval). Initially, the change circuit 41 selects the first setting circuit 42*a* and connects the first setting circuit 42*a* with the variable-frequency oscillation circuit 21 so that the voltage outputted by the first setting circuit 42*a* is applied to the variable-frequency oscillation circuit 21 as the control voltage. When being informed that the discharge lamp 5 has started lighting, the change circuit 41 determines that the build-up time interval (the transition time interval) commences. At this time, the change circuit 41 selects the second setting circuit 42*b* instead of the first setting circuit 42*a* and connects the second setting circuit 42*b* with the variable-frequency oscillation circuit 21. In this case, the voltage outputted by the second setting circuit 42*b* is applied to the variable-frequency oscillation circuit 21 as the control voltage. When the calculated impedance of the discharge lamp 5 exceeds the predetermined reference value, the change circuit 41 determines that the build-up time interval (the transition time interval) ends and the stably-lighting time interval commences. At this time, the change circuit 41 selects the third setting circuit 42*c* instead of the second setting circuit 42*b* and connects the third setting circuit 42*c* with the variable-frequency oscillation circuit 21. In this case, the voltage outputted by the third setting circuit 42*c* is applied to the variable-frequency oscillation circuit 21 as the control voltage.

The change circuit 41, the first, second, and third setting circuits 42*a*, 42*b*, and 42*c*, and the first and second detection resistors 43 and 44 compose a lighting control device 4.

Figure 3:
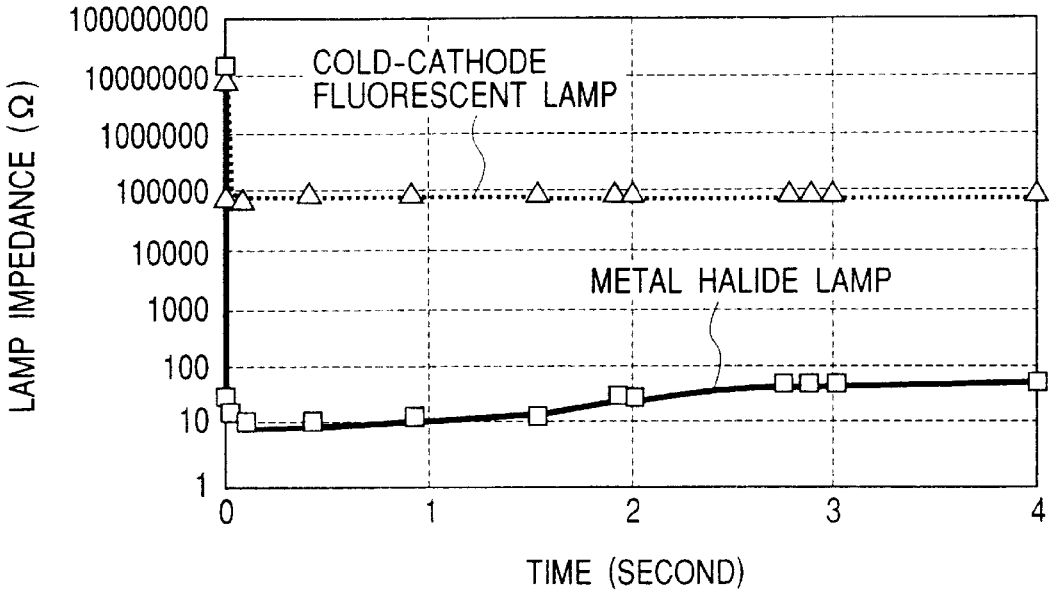
FIG. 3 is a diagram of the relation between the impedance of a metal halide lamp and the lapse of time from the moment of the start of the lighting thereof, and also the relation between the impedance of a cold-cathode fluorescent lamp and the lapse of time from the moment of the start of the lighting thereof.

FIG. 3 shows the experimentally-available relation between the impedance of a metal halide lamp and the lapse of time from the moment of the start of the lighting thereof. A "D2S" bulb produced by Phillips is used as the metal halide lamp. FIG. 3 also shows the experimentally-available relation between the impedance of a cold-cathode fluorescent lamp and the lapse of time from the moment of the start of the lighting thereof. With reference to FIG. 3, the impedance of the cold-cathode fluorescent lamp drops to a specific value in a short time interval after the start of the lighting thereof. Then, the impedance of the cold-cathode fluorescent lamp remains at the specific value. The impedance of the metal halide lamp drops to a minimum value in a short time interval after the start of the lighting thereof. During a given time interval thereafter, the impedance of the metal halide lamp remains at the minimum value. During a next limited time interval corresponding to a build-up time interval (a transition time interval), the impedance of the metal halide lamp increases from about 10Ω to about 100Ω. The predetermined reference value for the calculated impedance of the discharge lamp 5, which is used by the change circuit 41, is chosen to sense such an impedance increase or to sense the beginning of such an impedance increase. After the impedance-increase time interval, the impedance of the metal halide lamp remains at about 100Ω.

Figure 4:
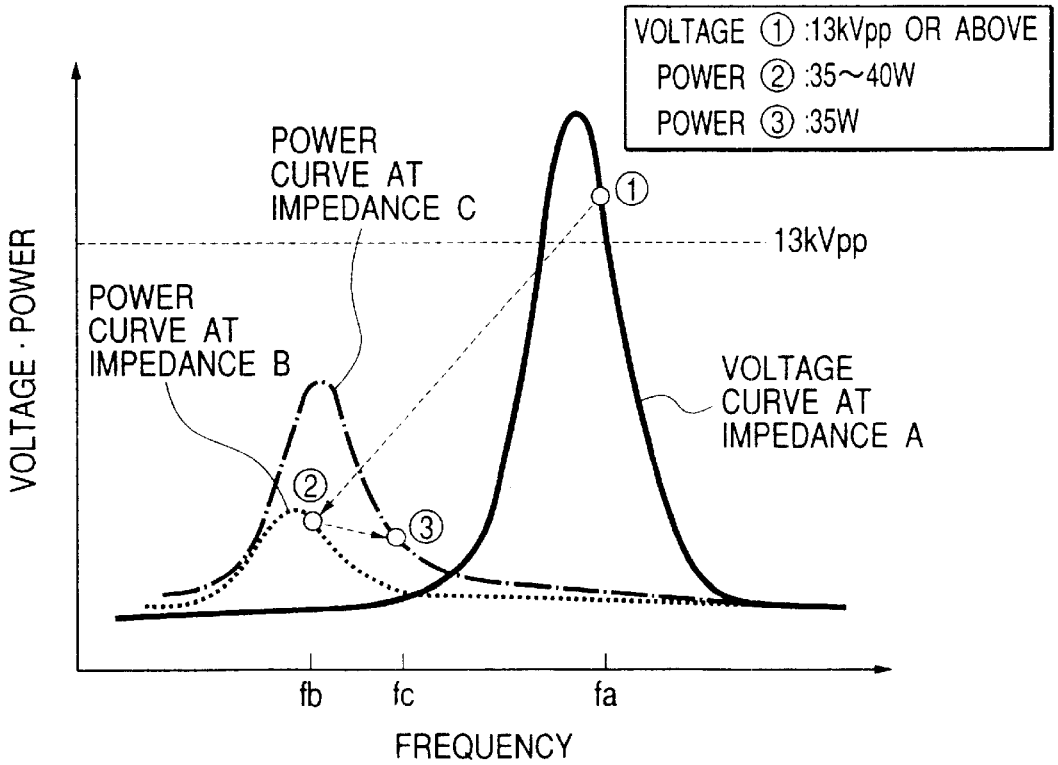
FIG. 4 is a diagram of the frequency response of a piezoelectric transformer in FIG. 2.

FIG. 4 shows the relation between the frequency of input power to the primary side of the piezoelectric transformer 3 and the voltage and power which appear at the secondary side of the piezoelectric transformer 3, that is, the voltage and power applied and fed to the discharge lamp 5. As shown in FIG. 4, each of a voltage-frequency characteristic curve and power-frequency characteristic curves exhibits a single-peak profile. As the impedance of a load on the piezoelectric transformer 3 increases, that is, as the impedance of the discharge lamp 5 increases, the position of the peak of a characteristic curve shifts toward a higher frequency side. As the impedance of the load on the piezoelectric transformer 3 increases, that is, as the impedance of the discharge lamp 5 increases, the peak of a characteristic curve rises in value or level. In FIG. 4, the impedance "A" denotes a relatively high impedance which is taken when the discharge lamp 5 is in an inactive state (a non-discharge state). The impedance "B" denotes a relatively low impedance equal to a central value or a representative value which is taken during the impedance-increase time interval (the build-up time interval or the transition time interval) after the start of the lighting of the discharge lamp 5. The impedance "C" denotes an intermediate impedance which is taken during the stably-lighting time interval after the impedance-increase time interval.

When the impedance "A" is taken, that is, when the discharge lamp 5 is in its inactive state (its non-discharge state), the position of the peak of the voltage-frequency characteristic curve is closest to a higher frequency side. When the discharge lamp 5 starts lighting, the impedance thereof drops and the position of the peak of a power-frequency characteristic curve shifts toward a lower frequency side (see the characteristic curve at the impedance "B" in FIG. 4). During the build-up time interval or the transition time interval, the impedance of the discharge lamp 5 rises to a specific value equal to about 100Ω. As the build-up time interval (the transition time interval) is replaced by the stably-lighting time interval, the impedance of the discharge lamp 5 rises and the position of the peak of a power-frequency characteristic curve shifts toward a higher frequency side (see the characteristic curve at the impedance "C" in FIG. 4).

The frequency of oscillation of the variable-frequency oscillation circuit 21, that is, the piezoelectric-transformer drive frequency, is decided by selected one of the voltages outputted from the first, second, and third setting circuits 42*a,* 42*b,* and 42*c*. Piezoelectric-transformer drive frequencies "fa", "fb", and "fc" are provided by the voltages outputted from the first, second, and third setting circuits 42*a,* 42*b,* and 42*c,* respectively. Voltage-frequency and power-frequency characteristic curves of the discharge lamp 5 are predetermined according to experiments. The piezoelectric-transformer drive frequencies "fa", "fb", and "fc" (that is, the voltages outputted from the first, second, and third setting circuits 42*a,* 42*b,* and 42*c*) are preset on the basis of the predetermined voltage-frequency and power-frequency characteristic curves so as to provide desired voltage values and desired power values.

The first setting circuit 42*a* includes a constant-voltage generator. The first setting circuit 42*a* outputs a fixed voltage. An example of the first setting circuit 42*a* has a circuit for dividing a battery voltage. Preferably, the voltage dividing circuit uses a zener diode for providing sufficient accuracy of the fixed voltage, and a design for temperature compensation. The piezoelectric-transformer drive frequency "fa" is preset on the basis of the voltage-frequency characteristic curve corresponding to the previously-indicated impedance "A". The presetting of the piezoelectric-transformer drive frequency "fa" is designed so that the voltage of the second AC power outputted from the piezoelectric transformer 3 will exceed the lower limit of a range in which puncture of insulation can occur in the discharge lamp 5. The lower limit of the insulation-puncture voltage range is referred to as a starting voltage. For example, the impedance "A" is equal to 15 MΩ, and the starting voltage (peak-to-peak) is equal to 13 kVpp.

Preferably, the piezoelectric-transformer drive frequency "fa" is higher than the frequency at which the piezoelectric-transformer output voltage peaks. The piezoelectric-transformer output voltage drops at a higher rate as the drive frequency decreases from the voltage-peak frequency. On the other hand, the piezoelectric-transformer output voltage drops at a lower rate as the drive frequency increases from the voltage-peak frequency. Accordingly, in the case where the piezoelectric-transformer drive frequency "fa" is higher than the voltage-peak frequency, the voltage of the second AC power outputted from the piezoelectric transformer 3 can reliably exceed the starting voltage even when the voltage outputted from the first setting circuit 42*a* slightly fluctuates.

Figure 5:
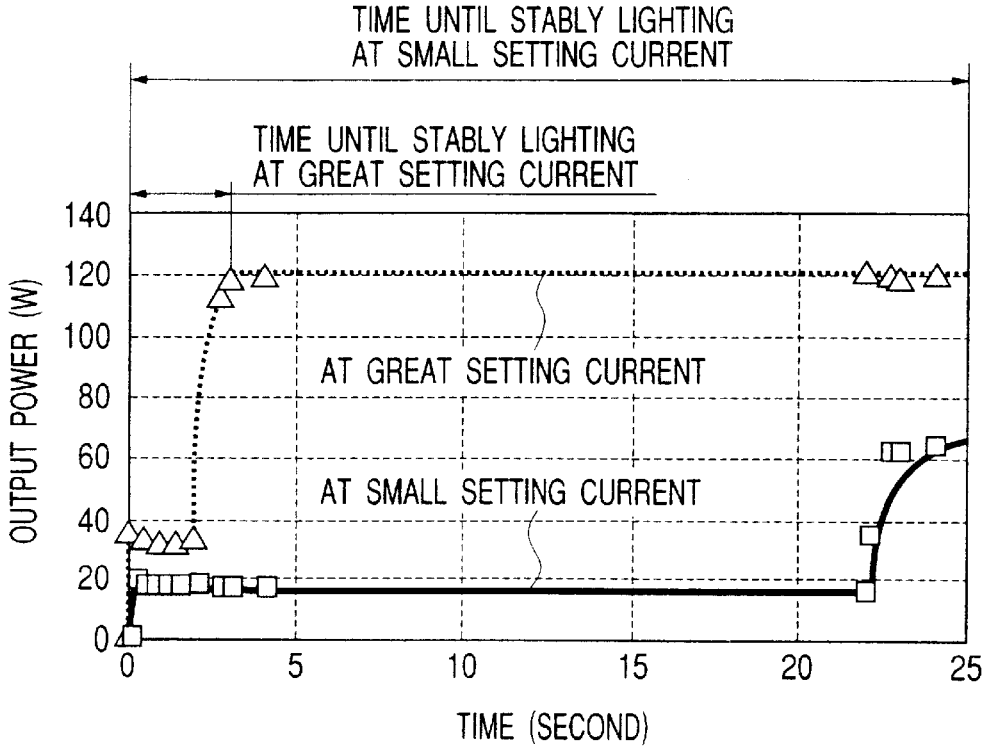
FIG. 5 is a diagram of the relation between the power output from a piezoelectric transformer and the lapse of time from the moment of the start of the lighting of a discharge lamp.

The second setting circuit 42*b* includes a constant-voltage generator. The second setting circuit 42*b* outputs a fixed voltage. An example of the second setting circuit 42*b* has a circuit for dividing a battery voltage. The second setting circuit 42*b* may be equal in basic structure to the first setting circuit 42*a*. FIG. 5 shows the relation between the power output from the piezoelectric transformer 3 and the lapse of time from the moment of the start of the lighting of the discharge lamp 5 which occurs at either a large value or a small value of the current fed to the discharge lamp 5. The piezoelectric transformer 3 acts as a constant-current power supply. Accordingly, the power output from the piezoelectric transformer 3 increases as the impedance of the discharge lamp 5 rises. It is understood from FIG. 5 that the build-up time interval (the transition time interval) between the start of the lighting of the discharge lamp 5 and the stably-lighting time interval shortens as the current fed to the discharge lamp 5 during the build-up time interval increases. The piezoelectric-transformer drive frequency "fb" is predetermined so that the corresponding current fed to the discharge lamp 5 will exceed a maximum value of the current fed during the stably-lighting time interval. The piezoelectric-transformer drive frequency "fb" may be predetermined so that the corresponding power fed to the discharge lamp 5 will exceed a maximum value of the power fed during the stably-lighting time interval. Therefore, the discharge lamp 5 can be quickly brought into the stably lighting state.

Figure 6:
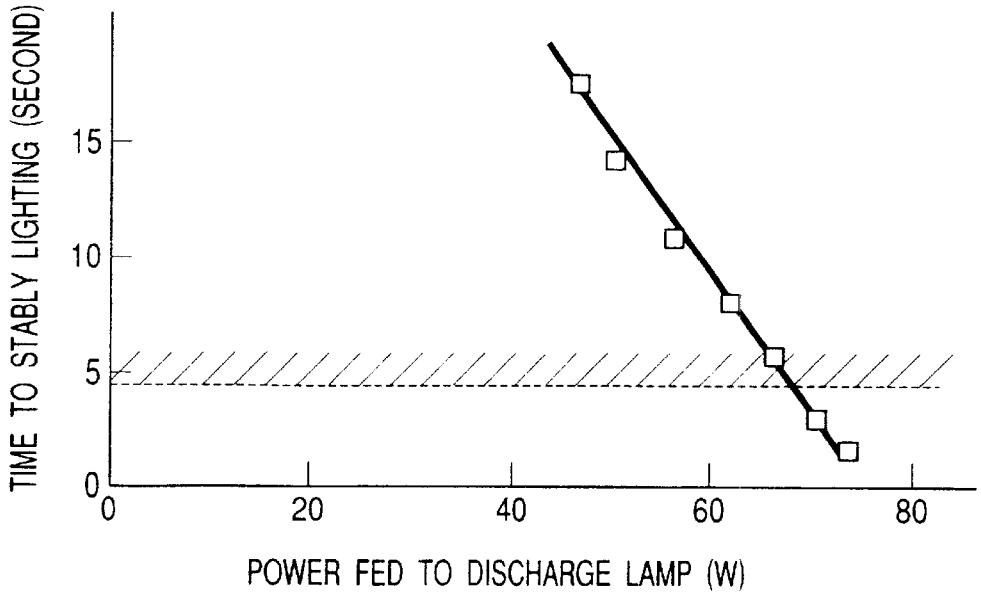
FIG. 6 is a diagram of the relation between the power fed to a discharge lamp and the time interval between the start of the lighting thereof and the moment at which the discharge lamp enters a stably lighting state.

FIG. 6 shows the relation between the power fed to the discharge lamp 5 and the time interval between the start of the lighting thereof and the moment at which the discharge lamp 5 enters the stably lighting state. With reference to FIG. 6, an increase in the power fed to the discharge lamp 5 shortens the time interval between the start of the lighting thereof and the moment at which the discharge lamp 5 enters the stably lighting state. Preferably, the power fed to the discharge lamp 5 during the build-up time interval is chosen in consideration of the upper limit of a power range in which the discharge lamp 5 is prevented from being overdriven. The piezoelectric-transformer drive frequency "fb" is preset on the basis of the voltage-frequency characteristic curve corresponding to the previously-indicated impedance "B". The presetting of the piezoelectric-transformer drive frequency "fb" is designed so that the corresponding power fed to the discharge lamp 5 will be equal to a desired value. For example, the impedance "B" is equal to 15Ω. Preferably, the power fed to the discharge lamp 5 during the build-up time interval is in the range of 65 W to 70 W. At a power of 75 W, the discharge lamp 5 may be overdriven and damaged.

Preferably, the piezoelectric-transformer drive frequency "fb" is higher than the frequency at which the piezoelectric-transformer output power peaks. The piezoelectric-transformer output power drops at a higher rate as the drive frequency decreases from the power-peak frequency. On the other hand, the piezoelectric-transformer output power drops at a lower rate as the drive frequency increases from the power-peak frequency. Accordingly, in the case where the piezoelectric-transformer drive frequency "fb" is higher than the power-peak frequency, the power output from the piezoelectric transformer 3 can be substantially stable even when the voltage outputted from the second setting circuit 42*b* slightly fluctuates.

The third setting circuit 42*c* receives the detection signals from the first and second detection resistors 43 and 44. In addition, the third setting circuit 42 receives a light-intensity adjustment signal from a suitable device (not shown) such as a light-intensity change switch which can be operated by a user. For example, the third setting circuit 42*c* includes a D/A converter for outputting a variable voltage to the change circuit 41. The third setting circuit 42*c* may include a microcomputer having a combination of an input/output port, a CPU, a ROM, and a RAM. In this case, the third setting circuit 42*c* operates in accordance with a program stored in the ROM. The program is designed to control the third setting circuit 42*c* to implement steps of operation which will be mentioned hereinafter. From the detection signal generated by the first detection resistor 43, the third setting circuit 42*c* gets information of the sensed current flowing through the discharge lamp 5. From the detection signal generated by the second detection resistor 44, the third setting circuit 42*c* gets information of the sensed voltage applied to the discharge lamp 5. The third setting circuit 42*c* multiplies the sensed current and the sensed voltage, thereby calculating the power fed to the discharge lamp 5. The third setting circuit 42*c* generates a voltage in response to the calculated power and the light-intensity adjustment signal. The third setting circuit 42*c* outputs the generated voltage to the change circuit 41. Accordingly, the third setting circuit 42*c* controls the piezoelectric-transformer drive frequency "fc" in response to the calculated power and the light-intensity adjustment signal. Specifically, the piezoelectric-transformer drive frequency "fc" is controlled so that the calculated power will be equal to a desired power given by the light-intensity adjustment signal.

The piezoelectric-transformer drive frequency "fc" is preset on the basis of the voltage-frequency characteristic curve corresponding to the previously-indicated impedance "C". Preferably, the piezoelectric-transformer drive frequency "fc" is variable in a range higher than the frequency at which the piezoelectric-transformer output power peaks. The piezoelectric-transformer output power drops at a higher rate as the drive frequency decreases from the power-peak frequency. On the other hand, the piezoelectric-transformer output power drops at a lower rate as the drive frequency increases from the power-peak frequency. Accordingly, in the case where the piezoelectric-transformer drive frequency "fc" is in the range higher than the power-peak frequency, the power output from the piezoelectric transformer 3 can be stably maintained at a desired level determined by the light-intensity adjustment signal.

The power fed to the discharge lamp 5 is controlled through the adjustment of the piezoelectric-transformer drive frequency "fc". The control of the power results in adjustment of the intensity of light emitted by the discharge lamp 5. Specifically, the intensity of light is adjusted to a level determined by the light-intensity adjustment signal.

Figure 7:
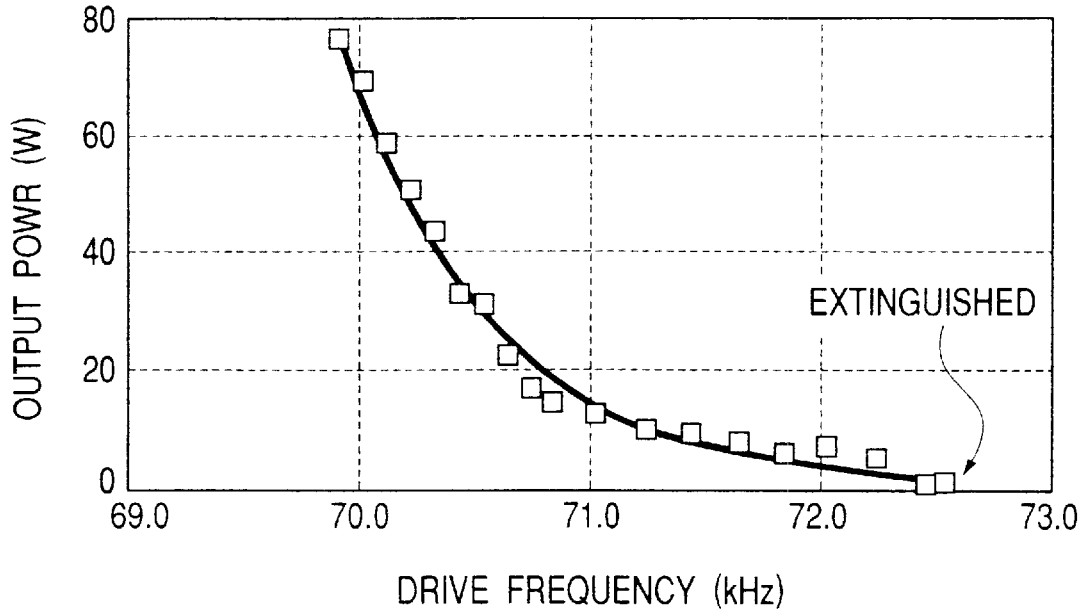
FIG. 7 is a diagram of the relation between the piezoelectric-transformer drive frequency and the piezoelectric-transformer power output.
Figure 8:
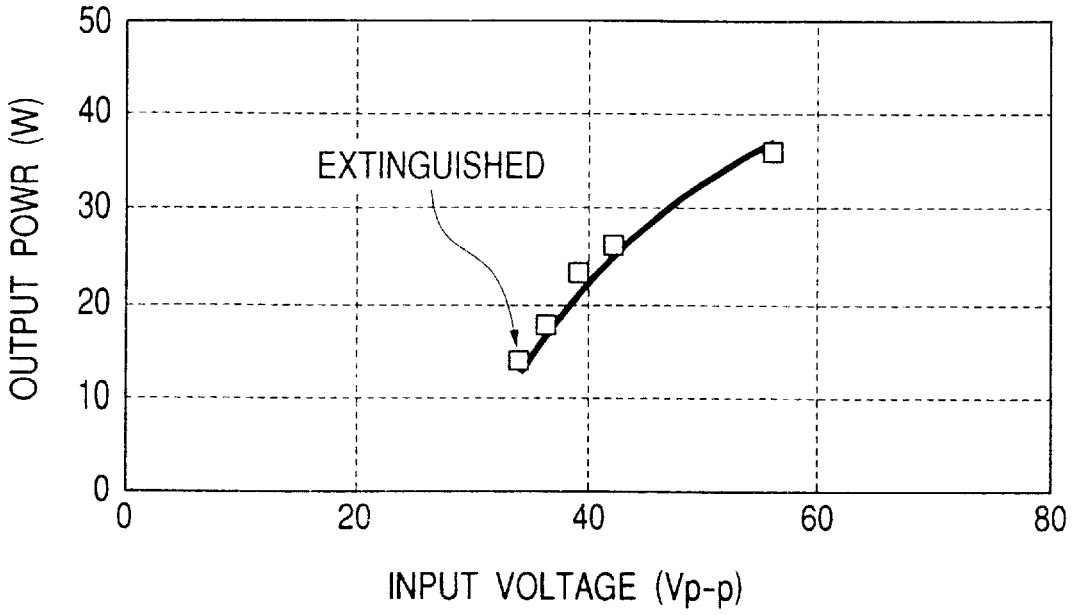
FIG. 8 is a diagram of the relation between the amplitude of a voltage inputted to a piezoelectric transformer and the power output therefrom which occurs when the piezoelectric-transformer drive frequency is held constant.

FIG. 7 shows the relation between the piezoelectric-transformer drive frequency and the power output from the piezoelectric transformer 3. FIG. 8 shows the relation between the amplitude of the voltage inputted to the piezoelectric transformer 3 and the power output therefrom which occurs when the piezoelectric-transformer drive frequency is held constant. With reference to FIG. 8, when the power output from the piezoelectric transformer 3 drops to 15 W, the discharge lamp 5 goes out. It is understood from FIG. 8 that assumed light-intensity control executed through changing the amplitude of the voltage inputted to the piezoelectric transformer 3 has a dynamic range extending between 35 W and 15 W. On the other hand, in the apparatus 1, the power output from the piezoelectric transformer 3 smoothly drops to about 0 W as the piezoelectric-transformer drive frequency rses (see FIG. 7). Thus, the apparatus 1 has a dynamic range extending between 75 W and 0.7 W. The piezoelectric transformer 3 acts as a current source, the output current from which depends on the drive frequency and the load impedance. The impedance of the discharge lamp 5 rises as the current fed thereto decreases. Preferably, the current fed to the discharge lamp 5 is decreased by controlling the piezoelectric-transformer drive frequency without changing the amplitude of the voltage inputted to the piezoelectric transformer 3. In this case, the voltage applied to the discharge lamp 5 can be prevented from significantly dropping, and can be maintained in a suitable range where the discharge lamp 5 is kept in a discharge state.

The apparatus 1 is designed as follows. During the build-up time interval (the transition time interval) before the stably-lighting time interval, the impedance of the discharge lamp 5 is relatively low. The piezoelectric-transformer drive frequency in the build-up time interval is set so that power comparable in level to or greater than that fed during the stably-lighting time interval will be supplied to the discharge lamp 5. Therefore, a sufficient amount of power is fed to the discharge lamp 5 in a short time, and the discharge lamp 5 quickly shifts to the stably lighting state.

The timing at which the second setting circuit 42*b* should be replaced by the third setting circuit 42*c*, that is, the timing which corresponds to the end of the build-up time interval (the transition time interval), is determined as follows. The impedance of the discharge lamp 5 is calculated on the basis of the detection signals generated by the first and second detection resistors 43 and 44. The replacement of the build-up time interval by the stably-lighting time interval is accurately detected on the basis of the calculated impedance of the discharge lamp 5 independent of various factors including a factor related to conditions of the discharge lamp 5, a factor of whether or not the discharge lamp 5 is in a cold-start condition, and a factor related to a characteristic variation from lamp to lamp.

The timing at which the second setting circuit 42*b* should be replaced by the third setting circuit 42*c* may be determined on the basis of a variation in the voltage applied to the discharge lamp 5 which occurs in accordance with a rise in the impedance thereof.

The change circuit 41 may be modified to implement the following steps of operation. The change circuit 41 includes a counter for measuring the lapse of time from the start of the lighting of the discharge lamp 5. The change circuit 41 determines whether or not the measured lapse of time reaches a predetermined time interval. When the measured lapse of time reaches the predetermined time interval, the change circuit 41 replaces the second setting circuit 42*b* by the third setting circuit 42*c*. In other words, the moment at which the measured lapse of time reaches the predetermined time interval is used as an indication of the end of the build-up time interval.

As previously mentioned, the third setting circuit 42*c* is designed so that the output voltage to the variable-frequency oscillation circuit 21 will be controlled in response to the power fed to the discharge lamp 5 and the light-intensity adjustment signal. In the case where a desired stability of the intensity of light emitted by the discharge lamp 5 is in a specified range, the third setting circuit 42*c* may be designed so that the output voltage to the variable-frequency oscillation circuit 21 will be controlled in response to only the light-intensity adjustment signal. The output voltage from the third setting circuit 42*c* is controlled to suitably adjust the piezoelectric-transformer drive frequency. Specifically, the control of the piezoelectric-transformer drive frequency is designed so that the power fed to the discharge lamp 5 will increase as the desired light intensity indicated by the light-intensity adjustment signal rises. In the case where the desired light intensity is constant, the third setting circuit 42*c* may be modified to output a fixed voltage.

Second Embodiment

Figure 9:
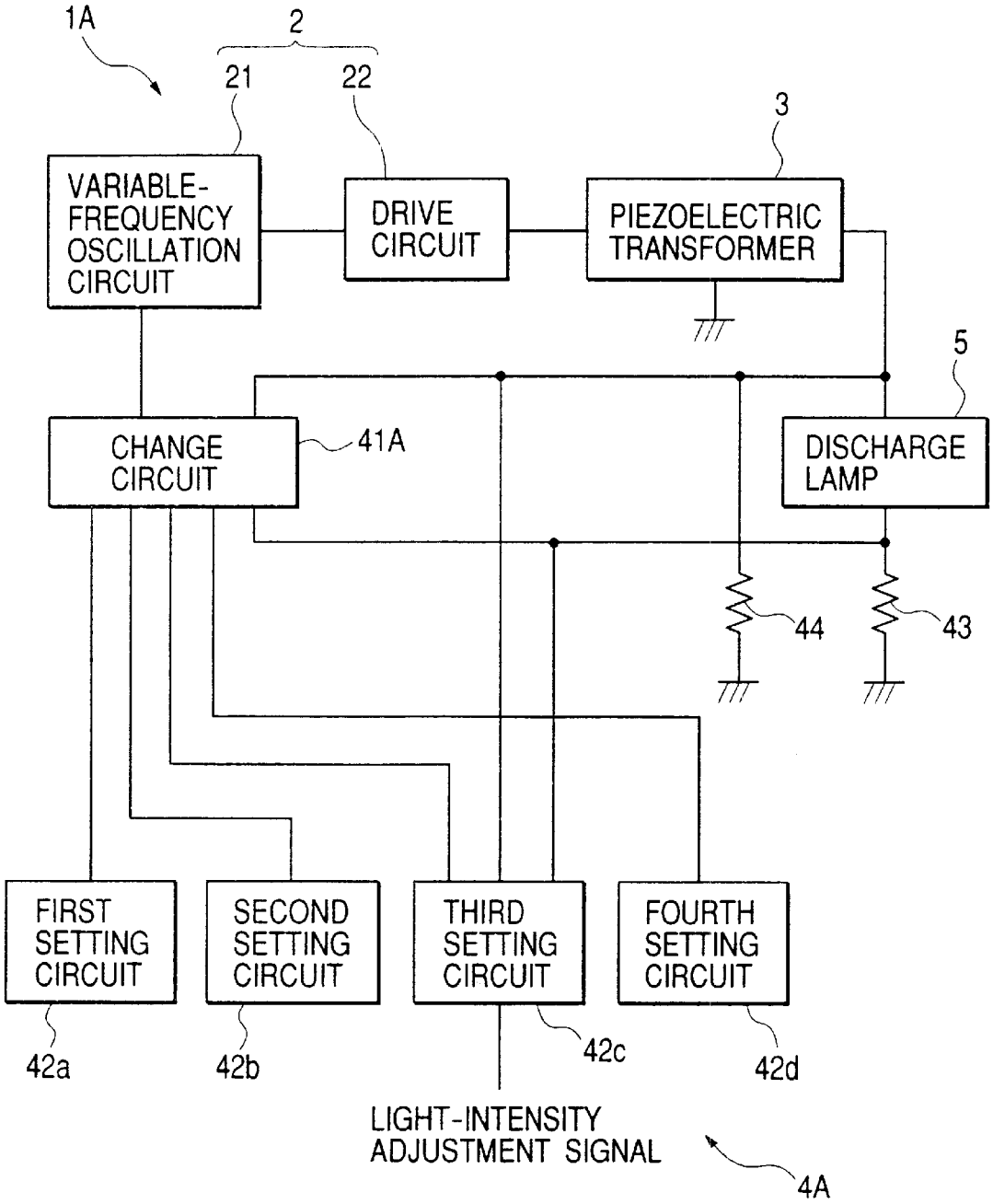
FIG. 9 is a block diagram of a discharge-lamp drive apparatus according to a second embodiment of this invention.

FIG. 9 shows a discharge-lamp drive apparatus 1A according to a second embodiment of this invention. The apparatus 1A is similar to the apparatus 1 (see FIG. 2) except for design changes mentioned later. The apparatus 1A includes a fourth setting circuit 42*d*. The apparatus 1A includes a change circuit 41A instead of the change circuit 41 (see FIG. 2). The fourth setting circuit 42*d* is connected to the change circuit 41A. The change circuit 41A, the first, second, third, and fourth setting circuits 42*a*, 42*b*, 42*c*, and 42*d*, and the first and second detection resistors 43 and 44 compose a lighting control device 4A. The lighting control device 4A is similar in basic structure to the lighting control device 4 (see FIG. 2).

The fourth setting circuit 42*d* generates a fourth voltage which can decide the frequency of oscillation of the variable-frequency oscillation circuit 21. The fourth setting circuit 42*d* outputs the fourth voltage to the change circuit 41A. The change circuit 41A selects one from among the voltages outputted by the first, second, third, and fourth setting circuits 42*a*, 42*b*, 42*c*, and 42*d* in response to the detection signals generated by the first and second detection resistors 43 and 44. The change circuit 41A passes the selected voltage to the variable-frequency oscillation circuit 21 as a voltage signal for setting the frequency of oscillation thereof. In other words, the change circuit 41A selects one from among the first, second, third, and fourth setting circuits 42*a*, 42*b*, 42*c*, and 42*d*, and connects the selected one with the variable-frequency oscillation circuit 21. The change circuit 41A calculates the impedance of the discharge lamp 5 on the basis of the detection signals generated by the first and second detection resistors 43 and 44. The change circuit 41A implements the selection of one from among the first, second, third, and fourth setting circuits 42*a*, 42*b*, 42*c*, and 42*d* in response to the calculated discharge-lamp impedance.

The first setting circuit 42*a* is designed for starting the discharge lamp 5 lighting. The second setting circuit 42*b* is designed for power feed to the discharge lamp 5 during a latter stage of a build-up time interval or a transition time interval following the start of the lighting of the discharge lamp 5. The third setting circuit 42*c* is designed for power feed to the discharge lamp 5 during a stably-lighting time interval following the build-up time interval (the transition time interval). The fourth setting circuit 42*d* is designed for power feed to the discharge lamp 5 during a former stage of the build-up time interval (the transition time interval).

Initially, the change circuit 41A selects the first setting circuit 42*a* and connects the first setting circuit 42*a* with the variable-frequency oscillation circuit 21 so that the voltage outputted by the first setting circuit 42*a* is applied to the variable-frequency oscillation circuit 21 as the control voltage. When being informed that the discharge lamp 5 has started lighting, the change circuit 41A determines that the build-up time interval (the transition time interval) commences. At this time, the change circuit 41A selects the fourth setting circuit 42*d* instead of the first setting circuit 42*a* and connects the fourth setting circuit 42*d* with the variable-frequency oscillation circuit 21. In this case, the voltage outputted by the fourth setting circuit 42*d* is applied to the variable-frequency oscillation circuit 21 as the control voltage. When the calculated impedance of the discharge lamp 5 exceeds a predetermined criterion, the change circuit 41A selects the second setting circuit 42*b* instead of the fourth setting circuit 42*d* and connects the second setting circuit 42*b* with the variable-frequency oscillation circuit 21. In this case, the voltage outputted by the second setting circuit 42*b* is applied to the variable-frequency oscillation circuit 21 as the control voltage. When the calculated impedance of the discharge lamp 5 exceeds a predetermined reference value, the change circuit 41A determines that the build-up time interval (the transition time interval) ends and the stably-lighting time interval commences. At this time, the change circuit 41A selects the third setting circuit 42*c* instead of the second setting circuit 42*b* and connects the third setting circuit 42*c* with the variable-frequency oscillation circuit 21. In this case, the voltage outputted by the third setting circuit 42*c* is applied to the variable-frequency oscillation circuit 21 as the control voltage. The predetermined reference value differs from the predetermined criterion. The predetermined reference value and the predetermined criterion may be equal to each other.

The frequency of oscillation of the variable-frequency oscillation circuit 21, that is, the piezoelectric-transformer drive frequency, is decided by selected one of the voltages outputted from the first, second, third, and fourth setting circuits 42*a*, 42*b*, 42*c*, and 42*d*. Piezoelectric-transformer drive frequencies "fa", "fb", "fc", and "fd" are provided by the voltages outputted from the first, second, third, and fourth setting circuits 42*a*, 42*b*, 42*c*, and 42*d* respectively. Voltage-frequency and power-frequency characteristic curves of the discharge lamp 5 are predetermined according to experiments. The piezoelectric-transformer drive frequencies "fa", "fb", "fc", and "fd" (that is, the voltages outputted from the first, second, third, and fourth setting circuits 42*a,* 42*b,* 42*c,* and 42*d*) are preset on the basis of the predetermined voltage-frequency and power-frequency characteristic curves so as to provide desired voltage values and desired power values.

Figure 10:
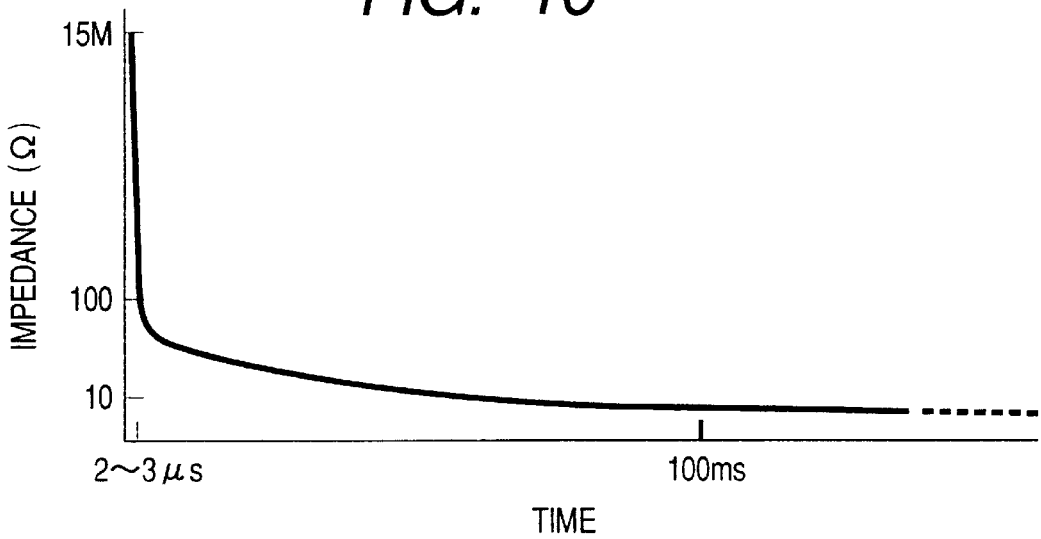
FIG. 10 is a diagram of the relation between the impedance of a discharge lamp and the lapse of time from the moment of the start of the lighting thereof.

FIG. 10 shows the relation between the impedance of the discharge lamp 5 and the lapse of time from the moment of the start of the lighting thereof. With reference to FIG. 10, the impedance of the discharge lamp 5 drops to a relatively low value (a specific value corresponding to the previously-indicated impedance "B") in a short time interval after the start of the lighting thereof. Specifically, the impedance of the discharge lamp 5 abruptly or steeply drops to a level slightly higher than the minimum value, and then gradually drops toward the minimum value. Accordingly, there is a relatively long period of time until the impedance of the discharge lamp 5 reaches the minimum value. For example, the impedance of the discharge lamp 5 abruptly or steeply drops to about 100Ω, and then gradually drops to about 10Ω in about 100 ms.

Figure 11:
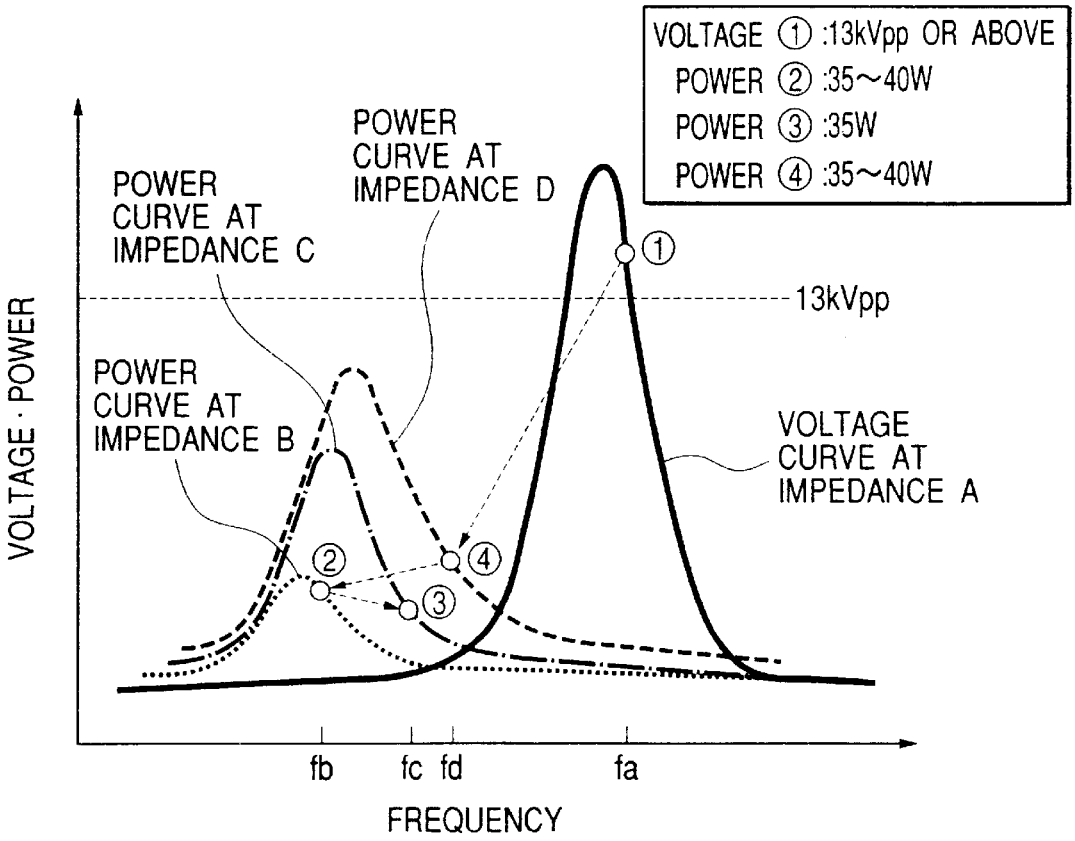
FIG. 11 is a diagram of the frequency response of a piezoelectric transformer in FIG. 9.

FIG. 11 is similar to FIG. 4 except that a power-frequency characteristic curve corresponding to an impedance "D" is additionally illustrated. The impedance "D" denotes an impedance equal to a central value or a representative value which is taken during a former stage of the impedance-increase time interval (the build-up time interval or the transition time interval) following the start of the lighting of the discharge lamp 5. The impedance "D" is equal to, for example, 100Ω. The impedance "D" during the former stage of the build-up time interval is slightly high. The peak of the power-frequency characteristic curve corresponding to the impedance "D" is higher than that of the power-frequency characteristic curve corresponding to the impedance "C". The position of the peak of the power-frequency characteristic curve corresponding to the impedance "D" is closer to a higher frequency side than that of the peak of the power-frequency characteristic curve corresponding to the impedance "C" is.

The fourth setting circuit 42*d* includes a constant-voltage generator. The fourth setting circuit 42*d* outputs a fixed voltage. An example of the fourth setting circuit 42*d* has a circuit for dividing a battery voltage. Preferably, the voltage dividing circuit uses a zener diode for providing sufficient accuracy of the fixed voltage, and a design for temperature compensation. The piezoelectric-transformer drive frequency "fd" is preset on the basis of the power-frequency characteristic curve corresponding to the previously-indicated impedance "D". The presetting of the piezoelectric-transformer drive frequency "fd" is designed so that the discharge lamp 5 can be prevented from being overpowered during the former stage of the build-up time interval (the transition time interval). For example, the piezoelectric-transformer drive frequency "fd" is preset so that the corresponding power fed to the discharge lamp 5 will be equal to about 65 W when the impedance D is equal to about 100Ω.

The apparatus 1A has the following advantages. During the former stage of the build-up time interval (the transition time interval) before the stably-lighting time interval, the current or power fed to the discharge lamp 5 is suitably suppressed and hence the discharge lamp 5 is prevented from being overpowered. A sufficient amount of power is fed to the discharge lamp 5 in a short time without overpowering the discharge lamp 5.

The timing at which the fourth setting circuit 42*d* should be replaced by the second setting circuit 42*b,* that is, the timing which corresponds to the end of the former stage of the build-up time interval (the transition time interval), is determined as follows. The impedance of the discharge lamp 5 is calculated on the basis of the detection signals generated by the first and second detection resistors 43 and 44. The end of the former stage of the build-up time interval is accurately detected on the basis of the calculated impedance of the discharge lamp 5.

The change circuit 41A may be modified to implement the following steps of operation. The change circuit 41A includes a counter for measuring the lapse of time from the start of the lighting of the discharge lamp 5. The change circuit 41A determines whether or not the measured lapse of time reaches a predetermined time interval. When the measured lapse of time reaches the predetermined time interval, the change circuit 41A replaces the fourth setting circuit 42*d* by the second setting circuit 42*b*. The period of time until the impedance of the discharge lamp 5 drops to about the minimum level is experimentally measured. The predetermined time interval is based on the measured period of time. For example, the impedance of the discharge lamp 5 drops to about the minimum level (about 10Ω) in about 100 ms. Accordingly, the predetermined time interval is equal to about 100 ms.

Third Embodiment

Figure 12:
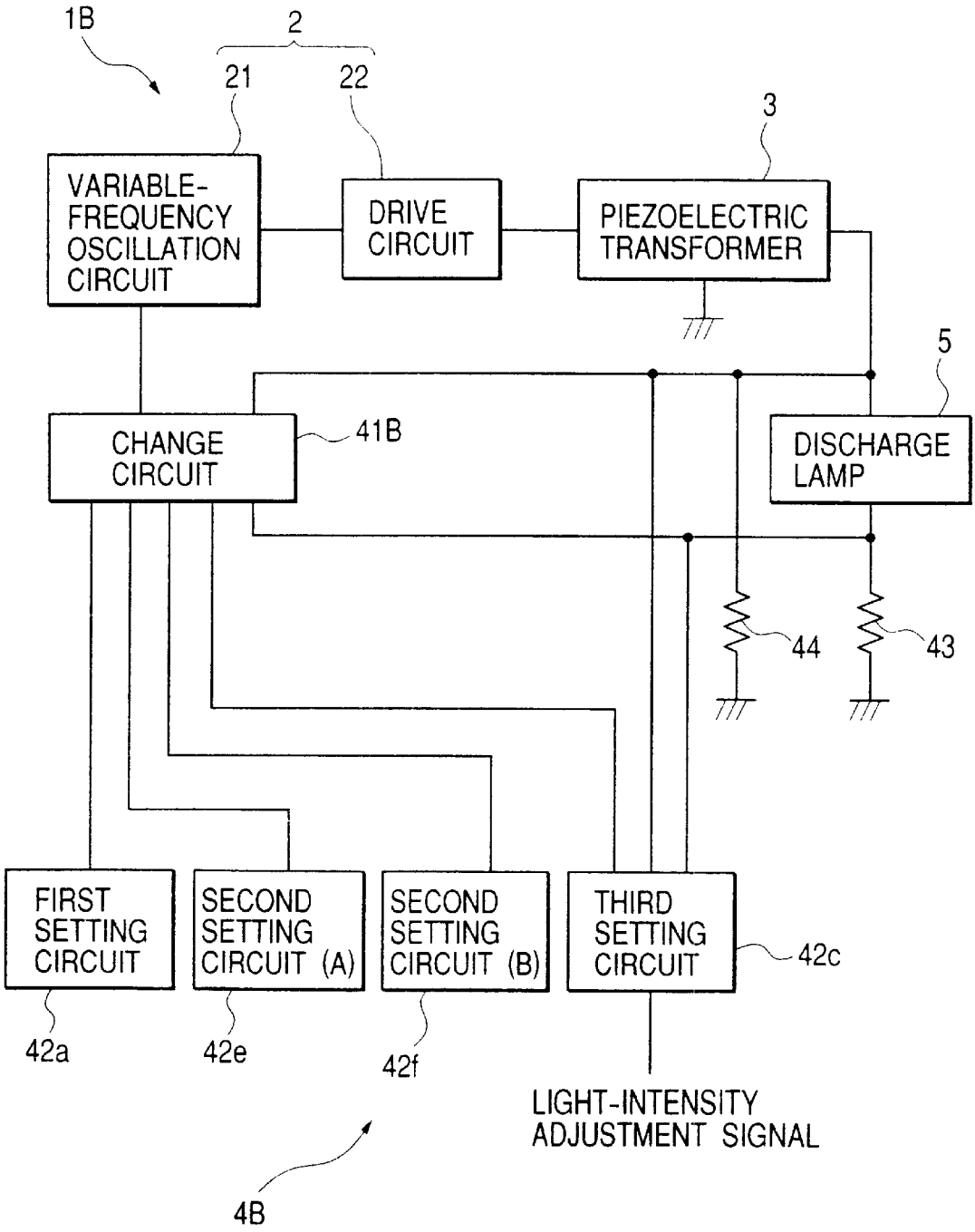
FIG. 12 is a block diagram of a discharge-lamp drive apparatus according to a third embodiment of this invention.

FIG. 12 shows a discharge-lamp drive apparatus 1B according to a third embodiment of this invention. The apparatus 1B is similar to the apparatus 1 (see FIG. 2) except for design changes mentioned later. The apparatus 1B includes a second setting circuit of a composite type instead of the second setting circuit 42*b* (see FIG. 2). The second setting circuit of the composite type has a sub setting circuit (A) 42*e* and a sub setting circuit (B) 42*f*. The apparatus 1B includes a change circuit 41B instead of the change circuit 41 (see FIG. 2). The sub circuits 42*e* and 42*f* in the second setting circuit are connected to the change circuit 41B. The change circuit 41B, the first and third setting circuits 42*a* and 42*c,* the sub circuits 42*e* and 42*f* in the second setting circuit, and the first and second detection resistors 43 and 44 compose a lighting control device 4B. The lighting control device 4B is similar in basic structure to the lighting control device 4 (see FIG. 2).

The sub circuit 42*e* in the second setting circuit generates a voltage which can decide the frequency of oscillation of the variable-frequency oscillation circuit 21. The sub circuit 42*e* outputs the generated voltage to the change circuit 41B. The sub circuit 42*f* in the second setting circuit generates a voltage which can decide the frequency of oscillation of the variable-frequency oscillation circuit 21. The sub circuit 42*f* outputs the generated voltage to the change circuit 41B. The change circuit 41B selects one from among the voltages outputted by the first and third setting circuits 42*a* and 42*c,* and the sub circuits 42*e* and 42*f* in the second setting circuit in response to the detection signals generated by the first and second detection resistors 43 and 44. The change circuit 41B passes the selected voltage to the variable-frequency oscillation circuit 21 as a voltage signal for setting the frequency of oscillation thereof. In other words, the change circuit 41B selects one from among the first and third setting circuits 42*a* and 42*c* and the sub circuits 42*e* and 42*f,* and connects the selected one with the variable-frequency oscillation circuit 21. The change circuit 41B calculates the impedance of the discharge lamp 5 on the basis of the detection signals generated by the first and second detection resistors 43 and 44. The change circuit 41B implements the selection of one from among the first and third setting circuits 42*a* and 42*c* and the sub circuits 42*e* and 42*f* in response to the calculated discharge-lamp impedance.

The sub circuits 42*e* and 42*f* in the second setting circuit are designed for power feed to the discharge lamp 5 during a build-up time interval or a transition time interval following the start of the lighting of the discharge lamp 5.

Initially, the change circuit 41B selects the first setting circuit 42*a* and connects the first setting circuit 42*a* with the variable-frequency oscillation circuit 21 so that the voltage outputted by the first setting circuit 42*a* is applied to the variable-frequency oscillation circuit 21 as the control voltage. When being informed that the discharge lamp 5 has started lighting, the change circuit 41B determines that the build-up time interval (the transition time interval) commences. At this time, the change circuit 41B selects the sub circuit 42*e* in the second setting circuit instead of the first setting circuit 42*a* and connects the sub circuit 42*e* with the variable-frequency oscillation circuit 21. In this case, the voltage outputted by the sub circuit 42*e* is applied to the variable-frequency oscillation circuit 21 as the control voltage. When the calculated impedance of the discharge lamp 5 reaches a preset value, the change circuit 41B selects the sub circuit 42*f* in the second setting circuit instead of the sub circuit 42*e* therein and connects the sub circuit 42*f* with the variable-frequency oscillation circuit 21. In this case, the voltage outputted by the sub circuit 42*f* is applied to the variable-frequency oscillation circuit 21 as the control voltage. When the calculated impedance of the discharge lamp 5 reaches the previously-indicated impedance "C" (corresponding to the stably lighting of the discharge lamp 5), the change circuit 41B determines that the build-up time interval (the transition time interval) ends and the stably-lighting time interval commences. At this time, the change circuit 41B selects the third setting circuit 42*c* instead of the sub circuit 42*f* in the second setting circuit and connects the third setting circuit 42*c* with the variable-frequency oscillation circuit 21. In this case, the voltage outputted by the third setting circuit 42*c* is applied to the variable-frequency oscillation circuit 21 as the control voltage. The preset impedance value at which the sub circuit 42*e* in the second setting circuit is replaced by the sub circuit 42*f* therein is lower than the previously-indicated impedance "C".

The piezoelectric-transformer drive frequency determined by the output voltage from the sub circuit 42*e* in the second setting circuit is chosen so that the corresponding power fed to the discharge lamp 5 will be equal to about 65 W. The piezoelectric-transformer drive frequency determined by the output voltage from the sub circuit 42*f* in the second setting circuit is chosen so that the corresponding power fed to the discharge lamp 5 will be equal to about 50 W. Therefore, during the build-up time interval (the transition time interval), the power fed to the discharge lamp 5 is decreased toward a stably-lighting power value (for example, 35 W) on a stepwise basis.

The inventors have found the following behavior of a metal halide lamp. The total luminance flux of light emitted from a metal halide lamp per unit applied power increases and then gradually decreases before stabilizing. In the case where power fed to a metal halide lamp remains constant during a build-up time interval (a transition time interval), the total luminance flux of light emitted from the lamp greatly increases. A person is dazzled when seeing such an increase in the total luminance flux.

In the apparatus 1B, during the build-up time interval (the transition time interval), the power fed to the discharge lamp 5 is decreased toward the stably-lighting power value. Thus, during the build-up time interval, an increase in the total luminance flux is suppressed so that a person seeing the discharge lamp 5 is prevented from being dazzled.

The pattern of the decrease in the power fed to the discharge lamp 5 during the build-up time interval depends on the preset impedance value at which the sub circuit 42*e* in the second setting circuit is replaced by the sub circuit 42*f* therein. The pattern of the decrease in the power fed to the discharge lamp 5 during the build-up time interval also depends on the voltages outputted from the sub circuits 42*e* and 42*f* in the second setting circuit. Preferably, the preset impedance value and the voltages outputted from the sub circuits 42*e* and 42*f* in the second setting circuit are equal to experimentally-available suitable values.

The apparatus 1B may be modified as follows. According to a modification of the apparatus 1B, the second setting circuit has three or more sub circuits outputting different voltages respectively. During the build-up time interval, one of the sub circuits is replaced by next one when the calculated impedance of the discharge lamp 5 increases across each of different preset values. Therefore, during the build-up time interval, the power fed to the discharge lamp 5 is decreased toward the stably-lighting power value on a finer stepwise basis. Thus, during the build-up time interval, the total luminance flux of light emitted from the discharge lamp 5 more smoothly varies in accordance with the lapse of time.

Fourth Embodiment

Figure 13:
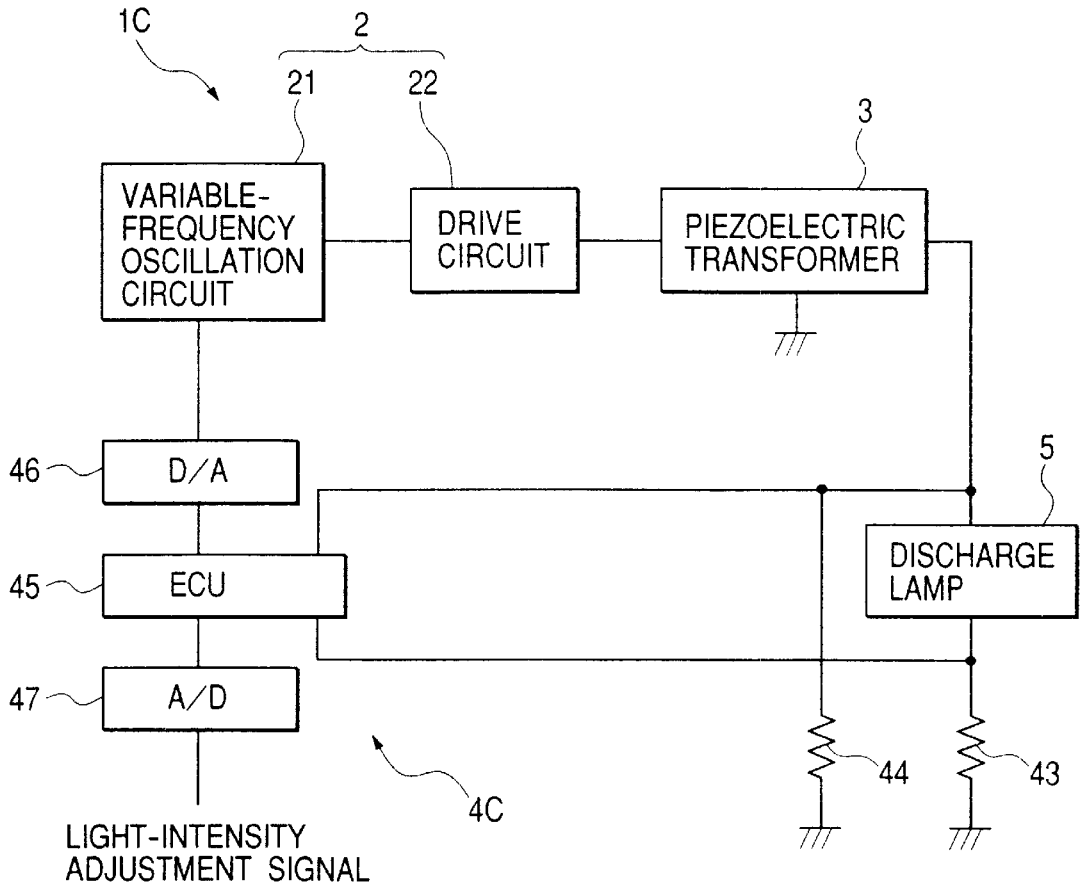
FIG. 13 is a block diagram of a discharge-lamp drive apparatus according to a fourth embodiment of this invention.

FIG. 13 shows a discharge-lamp drive apparatus 1C according to a fourth embodiment of this invention. The apparatus 1C is similar to the apparatus 1 (see FIG. 2) except for design changes mentioned later. The apparatus 1C includes an electronic control unit (ECU) 45, a digital-to-analog (D/A) converter 46, and an analog-to-digital (A/D) converter 47 instead of the change circuit 41, and the first, second, and third setting circuits 42*a*, 42*b*, and 42*c*. The ECU 45 is connected to the first and second detection resistors 43 and 44. The ECU 45 is also connected to the D/A converter 46 and the A/D converter 47. The D/A converter 46 is connected to the variable-frequency oscillation circuit 21. The ECU 45, the D/A converter 46, and the A/D converter 47 compose a lighting control device 4C.

The ECU 45 receives the detection signals generated by the first and second detection resistors 43 and 44. The A/D converter 47 receives an analog light-intensity adjustment signal. The A/D converter 47 changes the analog light-intensity adjustment signal into a corresponding digital light-intensity adjustment signal. The A/D converter 47 outputs the digital light-intensity adjustment signal to the ECU 45. The ECU 45 generates a digital control signal in response to the detection signals outputted from the first and second detection resistors 43 and 44, and the digital light-intensity adjustment signal outputted from the A/D converter 47. The ECU 45 outputs the digital control signal to the D/A converter 46. The D/A converter 46 changes the digital control signal into an analog control signal (a voltage signal). The D/A converter 46 outputs the analog control signal to the variable-frequency oscillation circuit 21 as a voltage signal for setting the frequency of oscillation thereof.

The ECU 45 includes a microcomputer or a similar device having a combination of an input/output port, a CPU, a ROM, and a RAM. The ECU 45 operates in accordance with a program stored in the ROM. The program is designed to control the ECU 45 to implement steps of operation which will be mentioned hereinafter.

From the detection signal generated by the first detection resistor 43, the ECU 45 gets information of the sensed current flowing through the discharge lamp 5. The ECU 45 determines whether or not the discharge lamp 5 has started lighting on the basis of the sensed current flowing therethrough. From the detection signal generated by the second detection resistor 44, the ECU 45 gets information of the sensed voltage applied to the discharge lamp 5. The ECU 45 calculates the impedance of the discharge lamp 5 from the sensed current flowing therethrough and the sensed voltage applied thereto. After the discharge lamp 5 has started lighting, the ECU 45 generates a digital control signal in response to the calculated impedance of the discharge lamp 5. The ECU 45 outputs the digital control signal to the D/A converter 46.

The digital control signal outputted from the ECU 45 to the D/A converter 46 determines the frequency of oscillation of the variable-frequency oscillation circuit 21. The piezoelectric-transformer drive frequency is equal to the frequency of oscillation of the variable-frequency oscillation circuit 21. Accordingly, the digital control,signal outputted from the ECU 45 to the D/A converter 46 determines the piezoelectric-transformer drive frequency. An initial state of the digital control signal is set so that the piezoelectric-transformer drive frequency is equal to the value "fa" at which a voltage sufficient to light the discharge lamp 5 can be applied thereto. During the build-up time interval (the transition time interval) after the start of the lighting of the discharge lamp 5, the digital control signal is set to control the piezoelectric-transformer drive frequency such that the power fed to the discharge lamp 5 decreases toward the stably-lighting power value as the calculated impedance thereof rises.

A plurality of different impedance values are preset as references for changing the digital control signal. The ROM in the ECU 45 stores information of a map indicating the correspondence relation between the digital control signal and the preset impedance values. A main routine of the program for the ECU 45 is repetitively executed at a predetermined period. The main routine calculates the impedance of the discharge lamp 5 on the basis of the sensed current flowing therethrough and the sensed voltage applied thereto. The main routine determines whether or not the calculated impedance exceeds one of the preset values. When the calculated impedance exceeds one of the preset values, the main routine sets a related flag. The main routine updates the digital control signal in response to the set flag by referring to the map. The correspondence relation between the digital control signal and the preset impedance values which is indicated by the map is experimentally decided so as to suppress an abrupt increase in the total luminance flux which might dazzle a person.

When the calculated impedance of the discharge lamp 5 reaches a value corresponding to the end of the build-up time interval, the ECU 45 sets the digital control signal so that a given power suited for a shift to the stably-lighting time interval is fed to the discharge lamp 5. Thereafter, the ECU 45 adjusts the digital control signal in response to the digital light-intensity adjustment signal outputted from the A/D converter 47. Specifically, the ECU 45 multiplies the sensed current and the sensed voltage, and hence calculates the power fed to the discharge lamp 5. The adjustment of the digital control signal is designed to equalize the calculated power to a desired value corresponding to the digital light-intensity adjustment signal.

In the apparatus 1C, the total luminance flux of light emitted from the discharge lamp 5 more smoothly varies during the build-up time interval (the transition time interval). The degree of the smoothness depends on the number of the preset impedance values being references for changing the digital control signal. The degree of the smoothness also depends on the resolution of the D/A converter 46. Preferably, the resolution of the D/A converter 46 corresponds to 4 bits.

The apparatus 1C may be modified as follows. According to a first modification of the apparatus 1C, a segment of the program for the ECU 45 is repetitively executed at a prescribed period. During every execution of the program segment, the digital control signal is updated in response to the calculated impedance of the discharge lamp 5.

In a second modification of the apparatus 1C, the digital control signal is designed so that the current fed to the discharge lamp 5 during a former stage of the build-up time interval is suppressed. The digital control signal may be designed so that the current fed to the discharge lamp 5 during a former stage of the build-up time interval will be smaller than that during a latter stage thereof. Thus, during the former stage of the build-up time interval, the power fed to the discharge lamp 5 is prevented from excessively increasing. Until the calculated impedance of the discharge lamp 5 drops to a predetermined value (for example, about 10Ω) after the start of the lighting thereof, the digital control signal is set independent of the previously-indicated map.

In a third modification of the apparatus 1C, after the calculated impedance of the discharge lamp 5 drops to the predetermined value (for example, about 10Ω), the digital control signal is set constant. Thus, the digital control signal is changed between two different states when the calculated impedance of the discharge lamp 5 drops to the predetermined value.

In a fourth modification of the apparatus 1C, the digital control signal is set constant during the build-up time interval.

Fifth Embodiment

Figure 14:
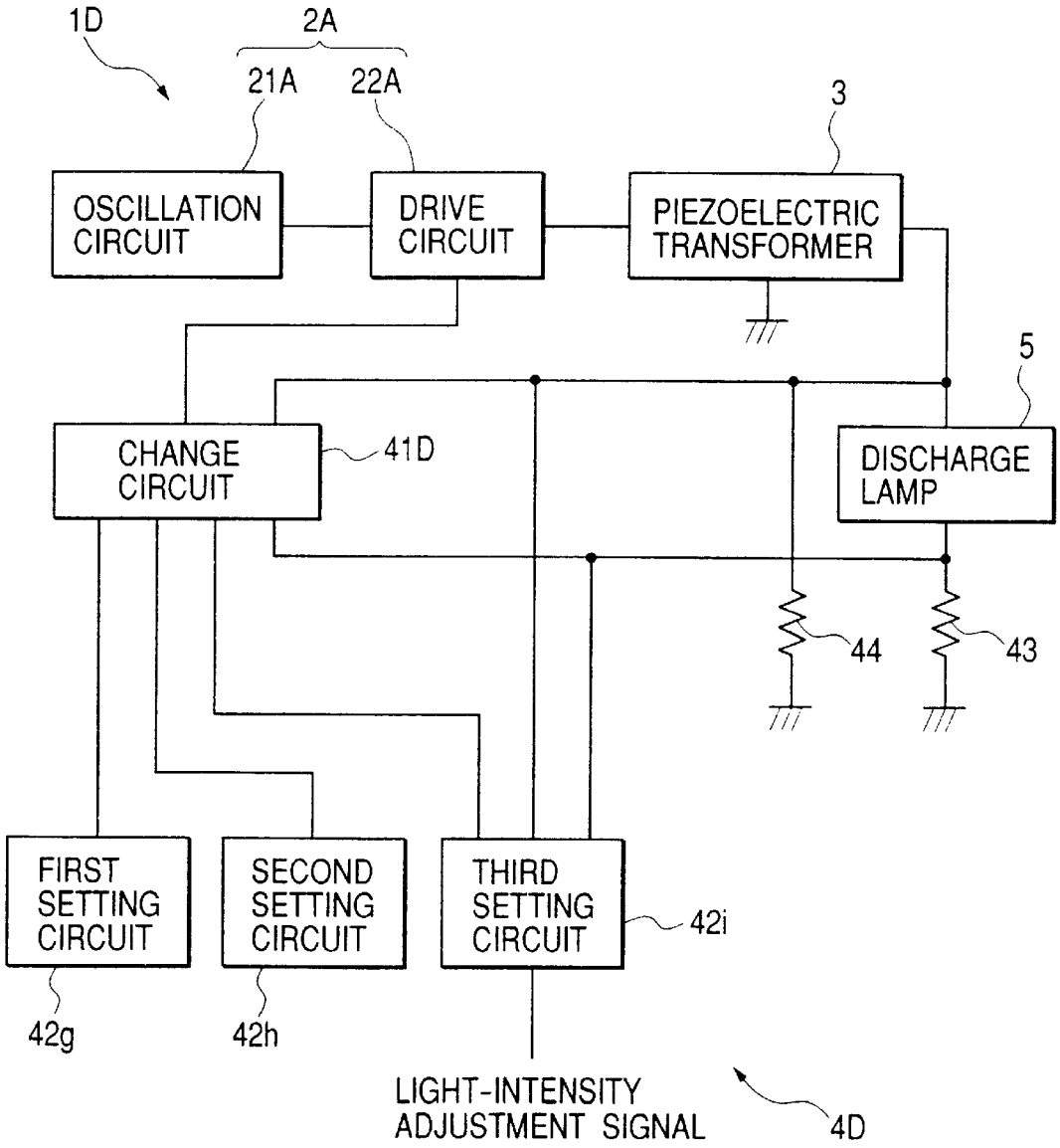
FIG. 14 is a block diagram of a discharge-lamp drive apparatus according to a fifth embodiment of this invention.

FIG. 14 shows a discharge-lamp drive apparatus 1D according to a fifth embodiment of this invention. The apparatus 1D is designed to drive a discharge lamp 5. The discharge lamp 5 includes a metal halide lamp.

The apparatus 1D includes a drive device 2A. The drive device 2A is composed of a fixed-frequency oscillation circuit 21A and a drive circuit 22A. The drive device 2A generates first AC power. The drive device 2A feeds the first AC power to a piezoelectric transformer 3. The drive circuit 22A is connected between the output side of the fixed-frequency oscillation circuit 21A and the primary side of the piezoelectric transformer 3. The fixed-frequency oscillation circuit 21A outputs a signal to the drive circuit 22A which has a predetermined constant frequency. The drive circuit 22A includes a variable-gain power amplifier. The drive circuit 22A converts the output signal of the fixed-frequency oscillation circuit 21A into first AC power which has an amplitude determined by the gain of the amplifier therein, and which has a frequency equal to the frequency of the output signal from the fixed-frequency oscillation circuit 21A. The first AC power is fed to the primary side of the piezoelectric transformer 3. Thus, the piezoelectric transformer 3 can be driven by the first AC power whose amplitude is determined by the gain of the drive circuit 22A. The drive circuit 22A is connected to a change circuit 41D which acts as a gain changing device. The gain of the drive circuit 22A (the gain of the amplifier in the drive circuit 22A) is set by a voltage signal fed from the change circuit 41D. The piezoelectric transformer 3 is of, for example, a Rosen type. The piezoelectric transformer 3 boosts the first AC power into second AC power which appears at the secondary side thereof. Since the amplitude of the first AC power is determined by the gain of the drive circuit 22A, the amplitude of the second AC power depends on the gain of the drive circuit 22A. Specifically, the amplitude of the second AC power increases as the gain of the drive circuit 22A increases.

A first detection resistor 43 is connected in series with the discharge lamp 5. The series combination of the discharge lamp 5 and the first detection resistor 43 is connected to the secondary side of the piezoelectric transformer 3. Thus, the second AC power generated by the piezoelectric transformer 3 can be fed to the discharge lamp 5. As previously mentioned, the second AC power fed to the discharge lamp 5 depends on the gain of the drive circuit 22A. A second detection resistor 44 is connected in parallel with the series combination of the discharge lamp 5 and the first detection resistor 43. A voltage across the first detection resistor 43 is inputted into the change circuit 41D as a detection signal. Also, a voltage across the second detection resistor 44 is inputted into the change circuit 41D as a detection signal. The first detection resistor 43 senses the current flowing through the discharge lamp 5. Thus, the detection signal generated by the first detection resistor 43 indicates the sensed current flowing through the discharge lamp 5. The second detection resistor 44 senses the voltage applied to the discharge lamp 5. Thus, the detection signal generated by the second detection resistor 44 indicates the sensed voltage applied to the discharge lamp 5.

The change circuit 41D includes, for example, a microcomputer having a combination of an input/output port, a CPU, a ROM, and a RAM. The change circuit 41D operates in accordance with a program stored in the ROM. The program is designed to control the change circuit 41D to implement steps of operation which will be mentioned hereinafter.

The change circuit 41D determines whether or not a current is flowing through the discharge lamp 5, that is, whether or not puncture of insulation occurs in the discharge lamp 5 on the basis of the detection signal generated by the first detection resistor 43. The change circuit 41D gets information of the start of the lighting of the discharge lamp 5 from the result of the above-mentioned determination. The first and second detection resistors 43 and 44, and the change circuit 41D compose an impedance detection device. From the detection signal generated by the first detection resistor 43, the change circuit 41D gets information of the sensed current flowing through the discharge lamp 5. From the detection signal generated by the second detection resistor 44, the change circuit 41D gets information of the sensed voltage applied to the discharge lamp 5. The change circuit 41D divides the sensed voltage by the sensed current, thereby calculating the impedance of the discharge lamp 5. The change circuit 41D determines whether or not the calculated impedance of the discharge lamp 5 exceeds a predetermined reference value.

The change circuit 41D is connected to first, second, and third setting circuits 42*g*, 42*h*, and 42*i*. The first setting circuit 42*g* generates a first voltage which can decide the gain of the drive circuit 22A. The first setting circuit 42*h* outputs the first voltage to the change circuit 41D. The second setting circuit 42*h* generates a second voltage which can decide the gain of the drive circuit 22A. The second setting circuit 42*h* outputs the second voltage to the change circuit 41D. The third setting circuit 42*i* receives a light-intensity adjustment signal from a suitable device (not shown) such as a light-intensity change switch which can be operated by a user. The third setting circuit 42*i* is connected to the first and second detection resistors 43 and 44. The third setting circuit 42*i* receives the detection signals from the first and second detection resistors 43 and 44. The third setting circuit 42*i* generates a third voltage in response to the light-intensity adjustment signal and the detection signals generated by the first and second detection resistors 43 and 44. The generated third voltage can decide the gain of the drive circuit 22A. The third setting circuit 42*i* outputs the third voltage to the change circuit 41D. The change circuit 41D selects one from among the voltages outputted by the first, second, and third setting circuits 42*g*, 42*h*, and 42*i* in response to the detection signals generated by the first and second detection resistors 43 and 44. The change circuit 41D passes the selected voltage to the drive circuit 22A as the voltage signal for setting the gain thereof. In other words, the change circuit 41D selects one from among the first, second, and third setting circuits 42*g*, 42*h*, and 42*i*, and connects the selected one with the drive circuit 22A.

The first setting circuit 42*g* is designed for starting the discharge lamp 5 lighting. The voltage outputted from the first setting circuit 42*g* is fixed. The gain of the drive circuit 22A which is given by the voltage outputted from the first setting circuit 42*g* causes the discharge lamp 5 to be fed with power sufficient for lighting. The second setting circuit 42*h* is designed for power feed to the discharge lamp 5 during a build-up time interval or a transition time interval following the start of the lighting of the discharge lamp 5. The voltage outputted from the second setting circuit 42*h* is fixed. The gain of the drive circuit 22A which is given by the voltage outputted from the second setting circuit 42*h* causes the discharge lamp 5 to be fed with a current or power greater than that for a stably-lighting time interval after the build-up time interval (the transition time interval). The third setting circuit 42*i* is designed for power feed to the discharge lamp 5 during the stably-lighting time interval. For example, the third setting circuit 42*i* includes a D/A converter for outputting a variable voltage to the change circuit 41D. The third setting circuit 42*i* may include a microcomputer having a combination of an input/output port, a CPU, a ROM, and a RAM. In this case, the third setting circuit 42*i* operates in accordance with a program stored in the ROM. The program is designed to control the third setting circuit 42*i* to implement steps of operation which will be mentioned hereinafter. From the detection signal generated by the first detection resistor 43, the third setting circuit 42*i* gets information of the sensed current flowing through the discharge lamp 5. From the detection signal generated by the second detection resistor 44, the third setting circuit 42*i* gets information of the sensed voltage applied to the discharge lamp 5. The third setting circuit 42*i* multiplies the sensed current and the sensed voltage, thereby calculating the power fed to the discharge lamp 5. The third setting circuit 42*i* generates a voltage in response to the calculated power and the light-intensity adjustment signal. The third setting circuit 42*i* outputs the generated voltage to the change circuit 41. Accordingly, the third setting circuit 42*i* controls the gain of the drive circuit 22A in response to the calculated power and the light-intensity adjustment signal. Specifically, the gain of the amplifier 22A is controlled so that the calculated power will be equal to a desired power given by the light-intensity adjustment signal.

Initially, the change circuit 41D selects the first setting circuit 42*g* and connects the first setting circuit 42*g* with the drive circuit 22A so that the voltage outputted by the first setting circuit 42*g* is applied to the drive circuit 22A as the control voltage. When being informed that the discharge lamp 5 has started lighting, the change circuit 41D determines that the build-up time interval (the transition time interval) commences. At this time, the change circuit 41D selects the second setting circuit 42*h* instead of the first setting circuit 42*g* and connects the second setting circuit 42*h* with the drive circuit 22A. In this case, the voltage outputted by the second setting circuit 42*h* is applied to the drive circuit 22A as the control voltage. When the calculated impedance of the discharge lamp 5 exceeds the predetermined reference value, the change circuit 41D determines that the build-up time interval (the transition time interval) ends and the stably-lighting time interval commences. At this time, the change circuit 41D selects the third setting circuit 42*i* instead of the second setting circuit 42*h* and connects the third setting circuit 42*i* with the drive circuit 22A. In this case, the voltage outputted by the third setting circuit 42*i* is applied to the drive circuit 22A as the control voltage.

The change circuit 41D, the first, second, and third setting circuits 42*g,* 42*h,* and 42*i,* and the first and second detection resistors 43 and 44 compose a lighting control device 4D.

The range of the voltage applied to the discharge lamp 5 after the lighting thereof is set in consideration of the voltage range in which the discharge lamp 5 can be kept lighting.

The apparatus 1D has the following advantage. A sufficient amount of power is fed to the discharge lamp 5 in the build-up time interval, and the discharge lamp 5 quickly shifts to the stably lighting state.

Sixth Embodiment

Figure 15:
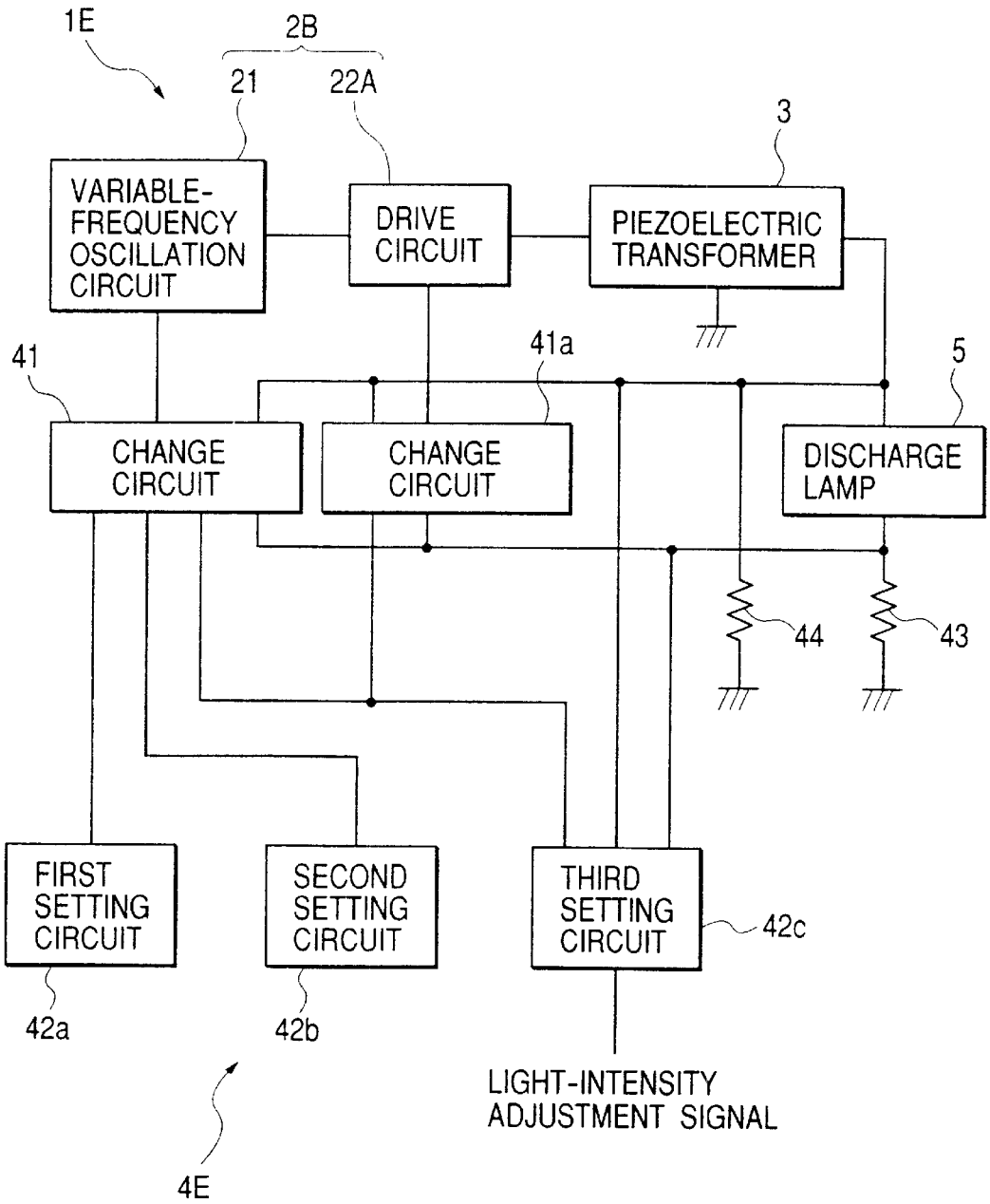
FIG. 15 is a block diagram of a discharge-lamp drive apparatus according to a sixth embodiment of this invention.

FIG. 15 shows a discharge-lamp drive apparatus 1E according to a sixth embodiment of this invention. The apparatus 1E is similar to the apparatus 1 (see FIG. 2) except for design changes mentioned later. The apparatus 1E includes a drive device 2B instead of the drive device 2 (see FIG. 2). The drive device 2B uses a drive circuit 22A instead of the drive circuit 22 (see FIG. 2). The apparatus 1E includes a change circuit 41*a*. The change circuit 41*a* is connected to the first and second detection resistors 43 and 44. The change circuit 41*a* receives the detection signals from the first and second detection resistors 43 and 44. The change circuit 41*a* is connected to the third setting circuit 42*c*. The change circuit 41*a* receives the voltage outputted from the third setting circuit 42*c*. The change circuits 41 and 41*a,* and the first, second, and third setting circuits 42*a,* 42*b,* and 42*c* compose a lighting control device 4E.

The drive device 2B generates first AC power. The drive device 2B feeds the first AC power to the piezoelectric transformer 3. The drive circuit 22A in the drive device 2B includes a variable-gain power amplifier. The drive circuit 22A converts the output signal of the variable-frequency oscillation circuit 21 into first AC power which has an amplitude determined by the gain of the amplifier therein, and which has a frequency equal to the frequency of the output signal from the variable-frequency oscillation circuit 21. The first AC power is fed to the primary side of the piezoelectric transformer 3. Thus, the piezoelectric transformer 3 can be driven at the frequency of the first AC power, that is, the frequency of oscillation of the variable-frequency oscillation circuit 21. In addition, the piezoelectric transformer 3 can be driven by the first AC power whose amplitude is determined by the gain of the drive circuit 22A. The drive circuit 22A is connected to the change circuit 41*a* which acts as a gain changing device. The gain of the drive circuit 22A, that is, the gain of the amplifier in the drive circuit 22A, is set by a voltage signal (a control voltage) fed from the change circuit 41*a*. The piezoelectric transformer 3 boosts the first AC power into second AC power which appears at the secondary side thereof. Since the amplitude of the first AC power is determined by the gain of the drive circuit 22A, the amplitude of the second AC power depends on the gain of the drive circuit 22A. Specifically, the amplitude of the second AC power increases as the gain of the drive circuit 22A increases. As in the apparatus 1 (see FIG. 2), the second AC power also depends on the frequency of oscillation of the variable-frequency oscillation circuit 21.

The change circuit 41*a* includes, for example, a microcomputer having a combination of an input/output port, a CPU, a ROM, and a RAM. The change circuit 41*a* operates in accordance with a program stored in the ROM. The program is designed to control the change circuit 41*a* to implement steps of operation which will be mentioned hereinafter.

The change circuit 41 a generates a voltage signal in response to the detection signals generated by the first and second detection resistors 43 and 44 and the voltage outputted from the third setting circuit 42*c*. The change circuit 41*a* outputs the generated voltage signal to the drive circuit 22A. The change circuit 41*a* detects the beginning and end of a build-up time interval (a transition time interval) in response to the detection signals generated by the first and second detection resistors 43 and 44. From the detection signal generated by the first detection resistor 43, the change circuit 41*a* gets information of the sensed current flowing through the discharge lamp 5. From the detection signal generated by the second detection resistor 44, the change circuit 41*a* gets information of the sensed voltage applied to the discharge lamp 5. The change circuit 41*a* divides the sensed voltage by the sensed current, thereby calculating the impedance of the discharge lamp 5. The change circuit 41*a* controls the voltage signal in response to the calculated impedance of the discharge lamp 5. Thus, the gain of the drive circuit 22A is controlled in response to the calculated impedance. The gain control is designed so that during the build20 up time interval (the transition time interval), the power fed to the discharge lamp 5 decreases toward the stably-lighting power value.

During a stably-lighting time interval after the build-up time interval, the change circuit 41*a* gets, from the voltage outputted by the third setting circuit 42*c,* information of a desired power value indicated by the light-intensity adjustment signal. The third setting circuit 42*c* calculates the power actually fed to the discharge lamp 5 on the basis of the detection signals generated by the first and second detection resistors 43 and 44. The change circuit 41*a* controls the voltage signal in response to the voltage outputted by the third setting circuit 42*c* (that is, the desired power value) and the calculated power fed to the discharge lamp 5. Thus, the gain of the drive circuit 22A is controlled in response to the desired power value and the calculated power. The gain control is designed so that during the stably-lighting time interval, the calculated power will be equal to the desired power value.

Preferably, during the build-up time interval, the control of the first AC power fed to the piezoelectric transformer 3 through the adjustment of the gain of the drive circuit 22A is designed to smooth a variation in the total luminance flux of light emitted from the discharge lamp 5. At the moment of the beginning of the build-up time interval and the moment of the shift to the stably-lighting time interval, the first AC power fed to the piezoelectric transformer 3 may be changed discontinuously or stepwise through the adjustment of the gain of the drive circuit 22A.

Seventh Embodiment

Figure 16:
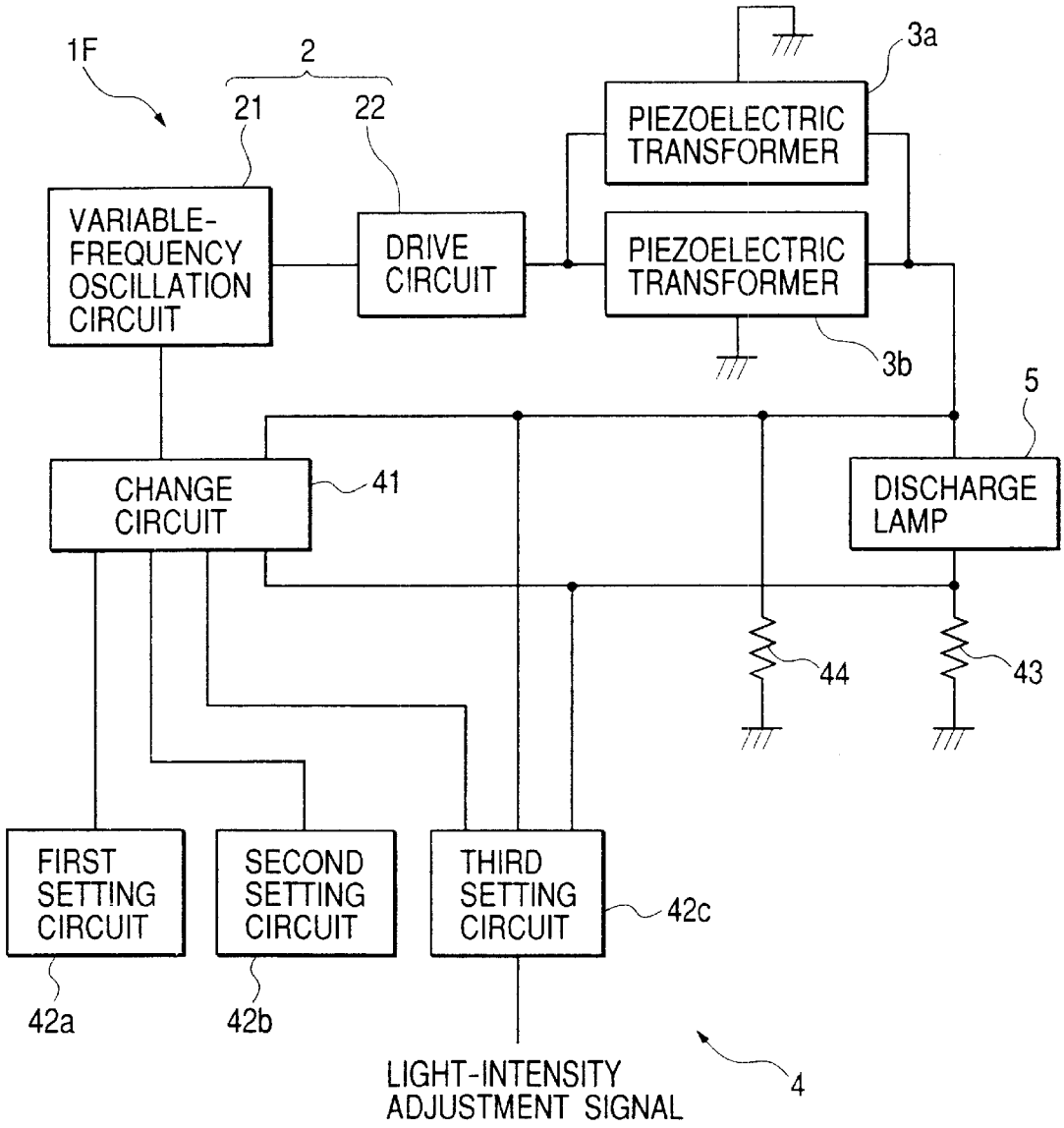
FIG. 16 is a block diagram of a discharge-lamp drive apparatus according to a seventh embodiment of this invention.

FIG. 16 shows a discharge-lamp drive apparatus 1F according to a seventh embodiment of this invention. The apparatus 1F is similar to the apparatus 1 (see FIG. 2) except for design changes mentioned later. The apparatus 1F includes a parallel combination of piezoelectric transformers 3*a* and 3*b* instead of the piezoelectric transformer 3 (see FIG. 2).

Eighth Embodiment

An eighth embodiment of this invention is similar to one of the second, third, fourth, fifth, and sixth embodiments thereof except that the piezoelectric transformer is replaced by a parallel combination of two or more piezoelectric transformers.

What is claimed is:

1. An apparatus for driving a discharge lamp, comprising:

a piezoelectric transformer connected to the discharge lamp;

drive means for feeding controllable power to the discharge lamp via the piezoelectric transformer to controllably drive the discharge lamp;

lighting control means for controlling the drive means to light the discharge lamp, the lighting control means including means for controlling the drive means to feed a first current to the discharge lamp during a build-up time interval before the discharge lamp changes to a stably lighting state; and means for controlling the drive means to feed a second current to the discharge lamp after the build-up time interval;

wherein the first current is greater than the second current.

2. An apparatus for driving a discharge lamp, comprising:

a piezoelectric transformer connected to the discharge lamp;

drive means for feeding controllable power to the discharge lamp via the piezoelectric transformer to controllably drive the discharge lamp;

lighting control means for controlling the drive means to light the discharge lamp, the lighting control means including means for controlling the drive means to feed a first current to the discharge lamp during a build-up time interval before the discharge lamp changes to a stably lighting state; and means for controlling the drive means to feed a second current to the discharge lamp after the build-up time interval;

wherein the first current is greater than the second current; and the lighting control means comprises:

impedance detecting means for detecting an impedance of the discharge lamp; and drive-state changing means for determining that the build-up time interval ends when the impedance detected by the impedance detecting means exceeds a predetermined value, and for controlling the drive means to change the discharge lamp from a drive state for the build-up time interval to a drive state for a stably-lighting time interval when determining that the build-up time interval ends.

3. An apparatus as recited in claim 2, wherein the lighting control means comprises:

means for controlling the drive means to feed a third current to the discharge lamp during a former stage of the build-up time interval; and means for controlling the drive means to feed a fourth current to the discharge lamp during a latter stage of the build-up time interval, the third current being smaller than the fourth current.

4. An apparatus as recited in claim 3, wherein the lighting control means comprises:

impedance detecting means for detecting an impedance of the discharge lamp; and drive-state changing means for determining that the former stage of the build-up time interval is replaced by the latter stage of the build-up time interval when the impedance detected by the impedance detecting means drops below a predetermined value, and for controlling the drive means to change the discharge lamp from a drive state for the former stage of the build-up time interval to a drive state for the latter stage of the build-up time interval when determining that the former stage of the build-up time interval is replaced by the latter stage of the build-up time interval.

5. An apparatus as recited in claim 2, wherein the lighting control means comprises means for controlling the drive means so that during the build-up time interval, the power fed to the discharge lamp will be decreased toward a power value occurring after the build-up time interval.

6. An apparatus as recited in claim 2, wherein the drive means operates at a variable drive frequency.

7. An apparatus as recited in claim 6, further comprising means for controlling the drive frequency at which the drive means operates to adjust an intensity of light emitted from the discharge lamp in response to a light-intensity adjustment signal.

8. An apparatus as recited in claim 6, wherein the drive frequency at which the drive means operates is higher than a resonant frequency of the piezoelectric transformer.

9. An apparatus as recited in claim 2, wherein the drive means operates at a variable voltage.

10. An apparatus for driving a discharge lamp, comprising:

a piezoelectric transformer connected to the discharge lamp;

first means for lighting the discharge lamp;

second means for feeding a first power to the discharge lamp via the piezoelectric transformer after the discharge lamp is lighted by the first means;

third means for detecting an impedance of the discharge lamp;

fourth means for determining whether or not the impedance detected by the third means exceeds a predetermined value after the discharge lamp is lighted by the first means; and fifth means for feeding a second power to the discharge lamp via the piezoelectric transformer after the fourth means determines that the impedance exceeds the predetermined value, the second power being smaller than the first power.

11. An apparatus as recited in claim 10, further comprising sixth means for decreasing the first power fed to the discharge lamp during a time interval after the discharge lamp is lighted and before the fourth means determines that the impedance exceeds the predetermined value.

12. A method of driving a discharge lamp via a piezoelectric transformer, comprising the steps of:

lighting the discharge lamp;

feeding a first power to the discharge lamp via the piezoelectric transformer after the discharge lamp is lighted;

detecting an impedance of the discharge lamp;

determining whether or not the detected impedance exceeds a predetermined value after the discharge lamp is lighted; and feeding a second power to the discharge lamp via the piezoelectric transformer after it is determined that the impedance exceeds the predetermined value, the second power being smaller than the first power.

13. A method as recited in claim 12, further comprising the step of decreasing the first power fed to the discharge lamp during a time interval after the discharge lamp is lighted and before it is determined that the impedance exceeds the predetermined value.

* * * * *